US007675532B2

(12) United States Patent
Iida et al.

(10) Patent No.: US 7,675,532 B2
(45) Date of Patent: Mar. 9, 2010

(54) IMAGE-FORMING APPARATUS AND CONTROL METHOD THEREOF

(75) Inventors: Ken-ichi Iida, Tokyo (JP); Hiroshi Kita, Mishima (JP); Hidetoshi Hanamoto, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 27 days.

(21) Appl. No.: 12/234,550

(22) Filed: Sep. 19, 2008

(65) Prior Publication Data

US 2009/0087207 A1 Apr. 2, 2009

(30) Foreign Application Priority Data

Sep. 28, 2007 (JP) ..... 2007-256012
Jul. 29, 2008 (JP) ..... 2008-195316

(51) Int. Cl.
*B41J 2/47* (2006.01)
*G03G 15/043* (2006.01)

(52) U.S. Cl. ..... 347/132; 347/237; 347/247

(58) Field of Classification Search ..... 347/117, 347/118, 129, 132, 233, 237, 247
See application file for complete search history.

(56) References Cited

U.S. PATENT DOCUMENTS

| | | | | |
|---|---|---|---|---|
| 6,185,029 | B1 * | 2/2001 | Ishihara | 359/216.1 |
| 7,142,339 | B2 * | 11/2006 | Tomioka | 359/196.1 |
| 7,271,942 | B2 * | 9/2007 | Tomioka | 359/204.4 |
| 7,346,298 | B2 | 3/2008 | Yamaguchi et al. | 399/256 |

FOREIGN PATENT DOCUMENTS

| | | |
|---|---|---|
| JP | 8-30084 | 2/1996 |
| JP | 2006-99043 | 4/2006 |

* cited by examiner

*Primary Examiner*—Huan H Tran
(74) *Attorney, Agent, or Firm*—Fitzpatrick, Cella, Harper & scinto

(57) ABSTRACT

An image-forming apparatus sets a DAC output voltage 1602, a VI conversion current ID 1603, and a laser current IL 1604 using a correction profile 1601, and performs density nonuniformity correction that addresses various factors contributing to density nonuniformity.

8 Claims, 24 Drawing Sheets

1ST APERTURE SIDE IMAGE RIGHT

2ND APERTURE SIDE IMAGE LEFT

FIG. 23B

| |
|---|
| $-7.5\% \leq D_d x \leq -2.5\%$ |
| $Vref_{-5}$ |
| $P_{-5}00$ |
| $P_{-5}01$ |
| ⋮ |
| $P_{-5}20$ |
| $P_{-5}21$ |
| $D_d x < -7.5\%$ |
| $Vref_{-10}$ |
| $P_{-10}00$ |
| $P_{-10}01$ |
| ⋮ |
| $P_{-10}20$ |
| $P_{-10}21$ |
| $+7.5\% \geq D_d x \geq +2.5\%$ |
| $Vref_{+5}$ |
| $P_{+5}00$ |
| $P_{+5}01$ |
| |
| $P_{+5}20$ |
| $P_{+5}21$ |
| $D_d x > +7.5\%$ |
| $Vref_{+10}$ |
| $P_{+10}00$ |
| $P_{+10}01$ |
| ⋮ |
| $P_{+10}20$ |
| $P_{+10}21$ |
| $+2.5\% > D_d x > -2.5\%$ |
| $Vref_0$ |
| $P_0 00$ |
| $P_0 01$ |
| ⋮ |
| $P_0 20$ |
| $P_0 21$ |

IMAGE-FORMING APPARATUS AND CONTROL METHOD THEREOF

BACKGROUND OF THE INVENTION

1. Field of the Invention

The present invention relates to an image-forming apparatus that forms an image using a developing-material and to a control method thereof.

2. Description of the Related Art

Generally, an electrophotographic image-forming apparatus forms an image by transferring a developing-material image (toner image) formed on the surface of a photosensitive drum, serving as an image carrier to a transfer material serving as a transfer medium.

There are also various systems for supplying developing-material. For example, with a process cartridge system, the photosensitive drum and the developing-material container are integrated, and the process cartridge needs to be replaced when the developing-material runs out. On the other hand, a developing-material replenishing system is known in which the developing container is newly replenished with developing-material when the developing-material runs out. With the developing-material replenishing system, a removable developing-material replenishing container is provided in the image-forming apparatus, and the developing container is replenished with developing-material from the developing-material replenishing container. More specifically, inventions have been proposed that have a developing-material circulation route in order to supply developing-material to a developing member (developing roller) after the developing-material inside the developing container and the developing-material newly replenished from the developing-material replenishing container have been sufficiently mixed inside the developing container. Japanese Patent Laid-Open No. 8-30084 (Patent Document 1) and Japanese Patent Laid-Open No. 2006-99043 (Patent Document 2) are examples thereof.

However, the following problems exist with the prior art. Generally, inside a developing apparatus, developing-material is repeatedly supplied to and eliminated from the developing roller. The charging characteristics deteriorate quite considerably during the repeated circulation of the developing-material inside the developing apparatus. This is because of the resin constituting the developing-material being abraded or deformed by mechanical rubbing. Deterioration of charging characteristics may also be caused by external additives that have been added to the surface of the developing-material separating or becoming embedded within the resin.

On the other hand, replenishing the developing container with new developing-material from the replenishing container means that newly replenished developing-material gets mixed with deteriorated developing-material inside the developing apparatus. The developing-material is carried inside the developing apparatus from one end to the other, and supplied to the developing roller. Consequently, developing-material with different charging characteristics ends up adhering to the developing roller on the upstream side and the downstream side in the carrying direction of the developing-material. This is not desirable since it causes density nonuniformity in the developing-material image formed with respect to the electrostatic latent image on the image carrier to occur in the longitudinal direction of the developing roller (parallel to the carrying direction of the developing-material).

Further, various factors contributing to density nonuniformity in an image-forming apparatus are envisioned apart from density nonuniformity in the developing apparatus, such as an OFS optical system, for example. Accordingly, it is desired to collectively address density nonuniformity caused by the developing apparatus and other factors.

SUMMARY OF THE INVENTION

In view of this, an object of the present invention is to solve at least one of the above and other problems. For example, the present invention provides an image-forming apparatus that suppresses the occurrence of image defects such as density nonuniformity, allowing a favorable image to be obtained. Note that other problems will become apparent throughout the specification.

According to an aspect of the present invention, for example, an image-forming apparatus includes an image carrier, a laser emitting unit which emits a light beam that is wider than a single deflection surface of a rotating polygonal mirror to forms a latent image on the image carrier, and a developing unit which forms a toner image by using toner. Further, the image-forming apparatus includes a supply unit which supplies toner to the developing unit while carrying the toner in a longitudinal direction of the developing unit, and a correction unit which corrects nonuniformity in image density in a main scanning direction that occurs when exposure by the laser emitting unit is performed, by altering amount of emitted light of the laser emitting unit from one end to the other end of the image carrier, and the correction unit, in emitting light with a downwardly convex light amount distribution in which amount of emitted light decreases and then increases from one end to the other end of the image carrier, differentiates a width by which amount of emitted light decreases from a width by which amount of emitted light increases, in order to correct fluctuation in image density caused by nonuniformity, due to an angle between the deflection surface and the emitted light beam, of an upwardly convex light amount distribution in which amount of light increases in a portion between two edge portions in the main scanning direction, and by continuous alteration in charging characteristics of the toner used, from an end of the image carrier corresponding to an upstream side in a carrying direction of the toner to the other end of the image carrier corresponding to a downstream side in the carrying direction of the toner.

Further features of the present invention will become apparent from the following description of exemplary embodiments with reference to the attached drawings.

BRIEF DESCRIPTION OF THE DRAWINGS

FIGS. 23A-1 and 23A-2 are flowcharts showing an exemplary method of setting a DAC reference voltage $V_{ref}$ value.

FIG. 23B shows exemplary correction profile data.

DESCRIPTION OF THE EMBODIMENTS

Preferred embodiments of the present invention will now be illustrated. The individual embodiments described below will be helpful in understanding a variety of concepts of the present invention from the generic to the more specific. Further, the technical scope of the present invention is defined by the claims, and is not limited by the following individual embodiments.

Embodiment 1

Description of Image-Forming Apparatus

Figure 1:
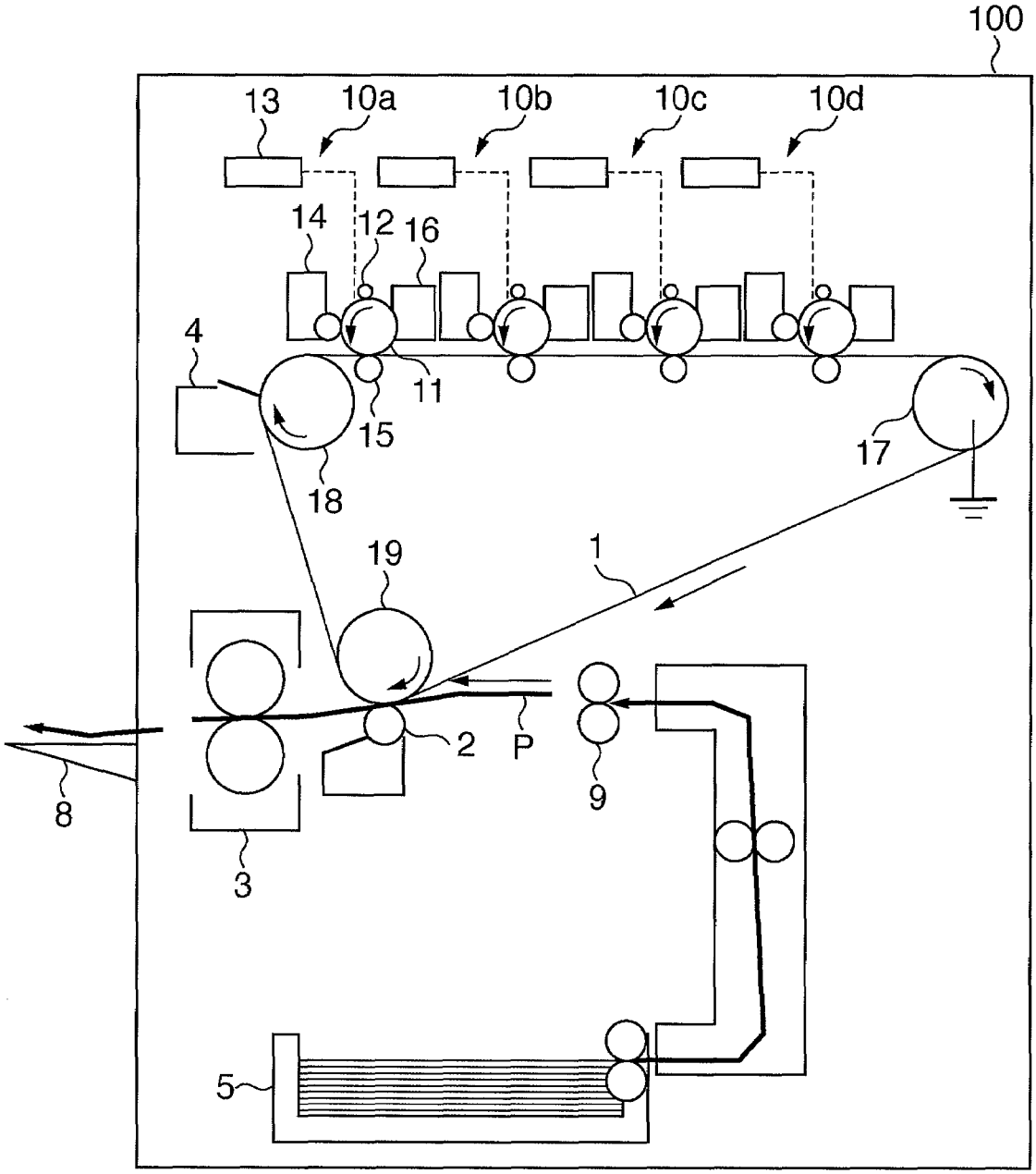
FIG. 1 is a configuration diagram of an image-forming apparatus of a preferred embodiment.

FIG. 1 is a configuration diagram of an image-forming apparatus of the present embodiment. The image-forming apparatus can be realized as a printing apparatus, a printer, a copier, a multifunction peripheral or a facsimile, for example. Specifically, an image-forming apparatus 100 is an intermediate transfer full-color printer with four image carriers. That is, the image-forming apparatus 100 has image-forming stations 10*a* to 10*d* corresponding to yellow (Y), magenta (M), cyan (C) and black (B). Further, the image-forming apparatus 100 has a transfer apparatus that includes an intermediate transfer belt 1 serving as an intermediate transfer body, and a fixing apparatus (fixing unit) 3.

The image-forming stations 10*a* to 10*d* together form an image-forming unit. Since the image-forming stations 10*a* to 10*d* have respectively common configurations, the following description will center on the image-forming station 10*a*.

In the image-forming stations 10*a* is installed a photosensitive drum (drum-shaped electrophotographic photoreceptor) 11 constituting an image carrier, so as to be rotatable in the direction of the arrow. On an outer surface of the photosensitive drum 11 is disposed a charging roller 12 that uniformly charges the surface of the respective photosensitive drums. Downstream of the charging roller 12 in the rotation direction of the photosensitive drum is disposed a laser exposure device 13 that exposes the photosensitive drum surface with a laser light modulated according to the image signal. Further, downstream of the laser exposure device 13 is disposed a developing apparatus 14 that develops the electrostatic latent image on the photosensitive drum surface formed by laser exposure, using a developing-material (toner) of a corresponding color.

In a position (transfer position) opposing the photosensitive drum 11 with the intermediate transfer belt 1 therebetween is installed a primary transfer roller 15 that forms a primary transfer unit together with the photosensitive drum.

The intermediate transfer belt 1 is looped around three rollers, namely, a drive roller 17, a tension roller 18 and a secondary transfer opposing roller 19, and runs the length of the image-forming stations 10*a* to 10*d* in contact with the respective photosensitive drums 11. The intermediate transfer belt 1 is rotationally driven in the direction of the arrow in FIG. 1 by the drive roller 17. Downstream of the primary transfer roller 15 in the rotation direction of the photosensitive drum 11 is installed a drum cleaner 16. On the surface of the intermediate transfer belt 1 is disposed a belt cleaner 4.

An image forming operation of the image-forming apparatus constituted as above will be described using the image-forming station 10*a* as an example. The photosensitive drum 11 of the image-forming station 10*a* is provided, for example, with an aluminum cylindrical body and a photoconductive layer formed on a surface thereof. The surface of the photosensitive drum 11 is negatively charged (e.g., charging potential VD=−400V) uniformly by the charging roller 12 while rotating in the direction of the arrow. Once exposure has been performed by the laser exposure device 13 (e.g., exposure potential VL=−100V), an electrostatic latent image corresponding to the yellow image component of the original is formed on the surface of the photosensitive drum 11.

The electrostatic latent image formed on the photosensitive drum 11 is developed by the developing apparatus 14 using negatively charged yellow toner, and visualized as a yellow toner image (reversal development). The toner is, for example, a negatively charged, non-magnetic one-component toner. The obtained yellow toner image is primary-transferred to the intermediate transfer belt 1 by the primary transfer roller 15. After the primary transfer, any residual transfer toner remaining on the surface of the photosensitive drum 11 is eliminated by the drum cleaner 16.

The above image-forming operation is executed in the image-forming stations 10*a* to 10*d* at a prescribed timing. Toner images of respectively different colors are primary-transferred sequentially from the photosensitive drums 11 onto the intermediate transfer belt 1. Subsequently, the toner images on the intermediate transfer belt 1 move, with the rotation of the intermediate transfer belt 1 in the direction of the arrows, to a secondary transfer unit formed by a secondary transfer roller 2 and the secondary transfer opposing roller 19. The toner images are therefore secondary-transferred onto a transfer material P supplied by supply rollers 9 at a prescribed timing. Transfer material may also be referred to as recording material, recording media, paper, sheets or transfer paper, for example. Subsequently, the transfer material P on which the unfixed toner image has been transferred is carried to the fixing apparatus 3, where it is heated and pressurized to become a permanent fixed image. The transfer material P discharged from the fixing apparatus 3 is discharged into a discharge tray 8.

Detailed Description of Developing Apparatus

Figure 2:
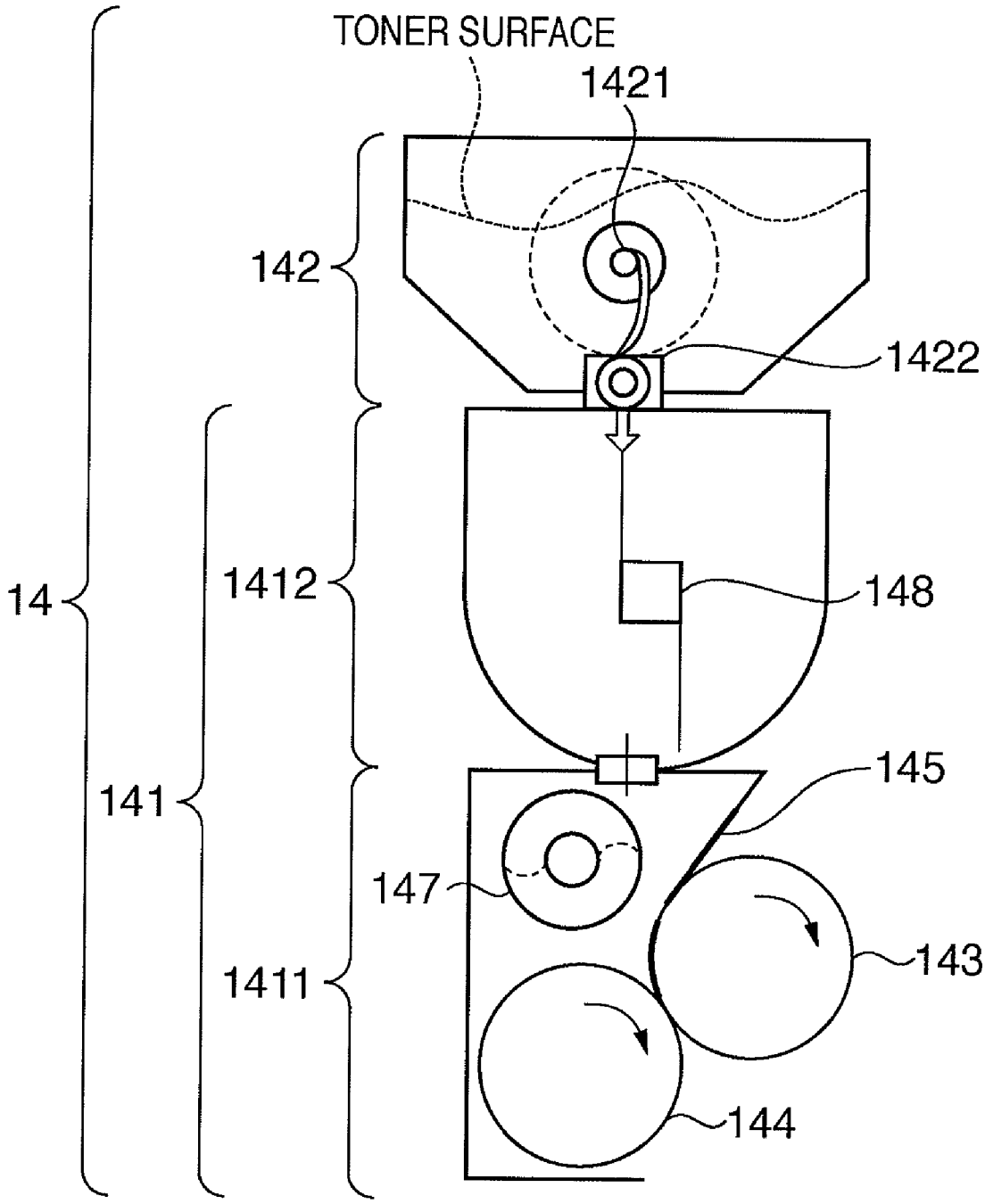
FIG. 2 is a configuration diagram of a developing apparatus according to a preferred embodiment.

FIG. 2 is a configuration diagram of a developing apparatus according to the present embodiment. The developing apparatuses provided in the image-forming stations have a similar configuration, although the color of the developing-material housed therein is different.

The developing apparatus 14 is provided with a developing container 141 and a toner hopper 142. The developing container 141 is provided with a developing unit 1411 and an agitating unit 1412. The developing unit 1411 is partially open on the side facing the photosensitive drum 11. A developing roller 143 serving as a developing member is partially exposed through this aperture. The developing roller 143 is rotatably supported by the developing container 141. Further, the developing roller 143 comes into contact with the photosensitive drum 11. Moreover, the developing roller 143 has a faster circumferential speed than the photosensitive drum 11. This is so that the toner adheres efficiently to the photosensitive drum 11.

A supply roller 144 for supplying toner to the developing roller 143 together with eliminating and recovering toner from the developing roller 143 has an elastic body. This supply roller 144 comes into contact with the developing roller 143 while rotating in the opposite direction thereto.

In the developing container 141 is provided a blade 145 serving as a toner layer regulating member. This blade 145, which is a plate spring constituted by stainless steel (SUS) or the like, comes into contact with the developing roller 143 at a prescribed contact pressure. The layer thickness of the toner supplied to the developing roller 143 is regulated by the blade 145 together with the rotation of the developing roller. At this time, the toner is assigned a negative electric charge by frictional charging. The thin layer of toner formed on the circumferential surface of the developing roller is then supplied to a developing area where the developing roller contacts the photosensitive drum, as a result of which the electrostatic latent image formed on the photosensitive drum is developed.

Toner that continues to be carried on the developing roller without contributing to the developing is stripped from the circumferential surface of the developing roller by the rubbing of the supply roller and returned to the developing container. On the other hand, toner that is still carried on the circumferential surface of the developing roller is again supplied to the developing area by the developing roller, together with toner newly supplied by the supply roller. A screw 147 and an agitating member 148 provided inside the developing container 141 and a unraveling member 1421 and a replenishing roller 1422 provided inside the toner hopper 142 are involved in carrying toner inside the developing apparatus.

Figure 3:
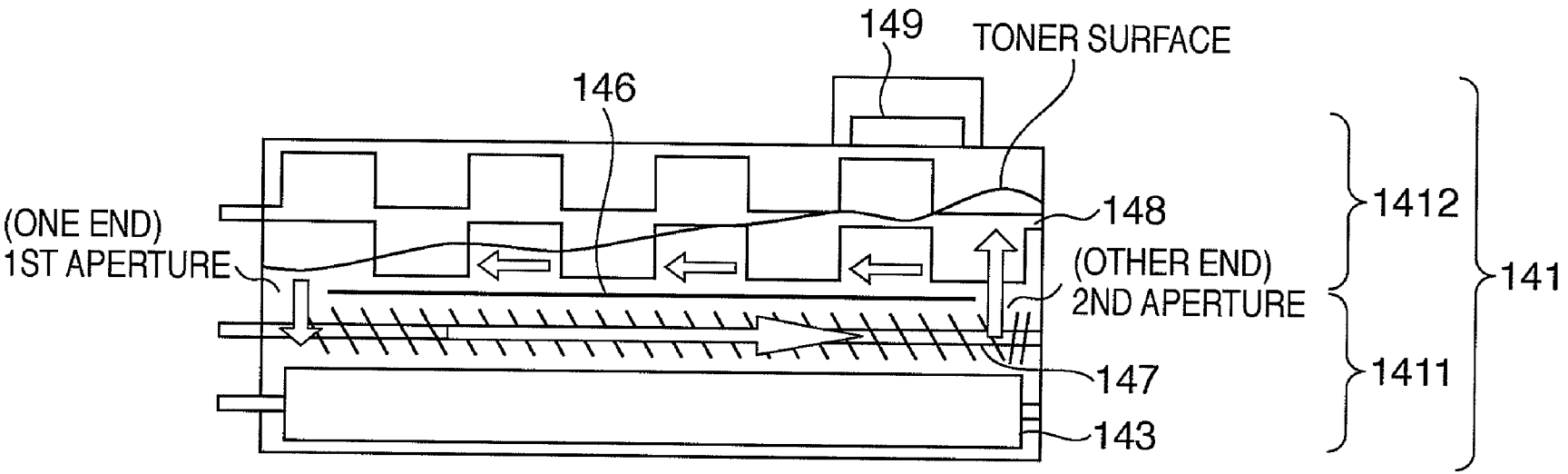
FIG. 3 is a schematic cross-sectional view of a developing container 141 according to a preferred embodiment.

FIG. 3 is a schematic cross-sectional view of the developing container 141 according of the present embodiment. This is a cross-sectional view of the right side of FIG. 2 as seen from the left side. The developing container 141 is divided horizontally into two upper and lower chambers (first storage chamber, second storage chamber) over the longitudinal direction of the developing container 141 by a partition wall 146. The developing unit 1411 serving as the first storage chamber has the developing roller 143 which serves as a developing member and the screw 147 which serves as a toner carrying member. This developing unit 1411 stores toner for supplying to the developing roller 143.

The agitating unit 1412 serving as the second storage chamber has the agitating member 148. This agitating unit 1412 is replenished with toner from the toner hopper 142 which serves as a toner replenishing unit, and temporarily stores the replenished toner as well as further supplying the developing unit 1411 with the replenished toner. The developing unit 1411 and the agitating unit 1412 are linked by apertures provided at either end in the longitudinal direction of the developing roller 143. In other words, the developing unit 1411 and the agitating unit 1412 are connected (communicate) at one end and the other end in the longitudinal direction of the developing roller 143.

The screw 147 inside the developing unit 1411 carries toner longitudinally inside the developing unit 1411. That is, this screw 147 carries toner that drops from a first aperture provided at one end in the longitudinal direction of the screw in a longitudinally central direction of the developing unit 1411 to a second aperture provided at the other end of the screw 147, and pushes the toner up into the agitating unit 1412 through the second aperture. The screw 147 also supplies toner to the developing roller 143 inside the developing unit 1411 as a result of this process.

On the other hand, the agitating member 148 inside the agitating unit 1412 has a plurality of blades, and toner is alternately dredged up and agitated by the rotation of the blades. The screw 147 and the agitating member 148 are connected to the developing roller 143 and the supply roller 144 by a gear (not shown). Consequently, the screw 147 and the agitating member 148 both perform a rotary action while the developing roller 143 is rotating, and both stop rotating when image formation ends. As a result of the functioning of these two members, toner circulates along the arrows in FIG. 3 while being sufficiently agitated inside the developing container 141.

The unraveling member 1421 and the replenishing roller 1422 are provided inside the toner hopper 142. Here, the unraveling member 1421 is for unraveling toner in the toner hopper 142. The replenishing roller 1422 is for replenishing the agitating unit 1412 with toner from the toner hopper 142 through a replenishing aperture 149 provided in the agitating unit 1412. This replenishing roller 1422 rotates as a result of a replenishing command from the image-forming apparatus 100, and replenishes the agitating unit 1412 with a constant amount of toner per unit of drive time. As a result, the amount of toner inside the developing container 141 is consistently maintained as a constant level. To detect the toner amount for the replenishing command, in the present embodiment a toner level sensor (not shown) is provided in the agitating unit 1412. When this toner level sensor detects that there is insufficient toner, the replenishing roller 1422 rotates and the agitating unit 1412 is replenished with toner from the toner hopper 142.

Distribution of Charged Electric Charge in Toner

Inside the developing container 141 of the present invention, toner is circulated over and again as a result of toner being repeatedly supplied to and eliminated from the developing roller inside the developing container. At this time, new toner that has just been newly replenished from the toner hopper is mixed with toner whose charging characteristics have deteriorated. The deteriorated toner and the new toner have mutually different charging characteristics. The reasons for this are as follows.

When the toner inside the developing container is repeatedly supplied to and eliminated from the developing roller, resin constituting the toner is abraded or deformed by mechanical rubbing. External additives that have been added to the surface of the developing-material may also separate or become embedded within the resin. Toner charging characteristics are determined by the geometric configuration and material properties of the resin and external additives constituting the toner. Consequently, the charging characteristics and the like of deteriorated toner will have altered in comparison to new toner. In other words, the amount of negative electric charge assigned by frictional charging when supplied to the developing roller is smaller for more deteriorated toner and larger for newer toner. Accordingly, (the absolute value of) the negative electric charge amount is smaller for more deteriorated toner and larger for newer toner.

The old and new toner is circulated after being thoroughly mixed inside the developing container by the functioning of the screw 147 and the agitating member 148. However, in the process whereby toner is supplied to the developing roller 143 while being carried inside the developing unit by the screw 147 along the longitudinal direction of the developing roller 143, a characteristic distribution in the longitudinal direction occurs in the toner layer formed on the developing roller. That is, when toner is carried from the first aperture in the direction of the second aperture, firstly new toner with favorable charging characteristics is preferentially used in layer formation in an upstream (nearer the first aperture) portion of the developing roller in the toner carrying direction. Then, in a downstream (nearer the second aperture) portion, layer formation is performed using degraded toner, carried downstream without being used in layer formation on the upstream side, whose charging characteristics have deteriorated. This results in a distribution in which there is a large amount of negatively charged electric charge on the upstream side in the carrying direction, which decreases on the downstream side, in terms of the average electric charge in the toner layer formed on the developing roller. This distribution of negatively charged electric charge may also alter dynamically with a certain degree of fixed alteration depending on the operating condition of the developing apparatus 14.

Hereinafter, exemplary measurements of charged electric charge will be illustrated. The specifications of the image-forming apparatus at this time were as follows. A color printer with a maximum usable transfer material size of A3 (width 297 mm) and a processing speed of 190 mm/sec was employed as the image-forming apparatus 100. Further, the A4 printing speed was 40 ppm and the resolution was 600 dpi. The photosensitive drum 11 is a negatively charged organic photoconductor (OPC) drum with a 31 mm diameter. The toner is a double-layer spherical toner manufactured by polymerization. The toner has a structure in which a binder layer of styrene-acrylic resin or the like called a shell encloses a center portion of wax. The particle size of the toner is approximately 6 μm. External additive particles such as silica have been added to the surface of the toner. Here, the same type of toner as that employed in the Canon LBP-5400 laser beam printer and the like was used. The outer diameter of the developing roller 143 is 20 mm. The developing roller 143 is a semiconductive elastic roller constituted by low hardness rubber or foam made from silicone, urethane or the like with a volume resistivity of $10^2$ Ωcm to $10^{10}$ Ωcm in which is dispersed a conductive material such as carbon. The developing roller 143 comes into contact with the photosensitive drum 11 while rotating in the forward direction at a circumferential speed 1.5 times that of the photosensitive drum. The supply roller 144 is an insulating sponge roller with a 16 mm outer diameter. The developing voltage applied to the developing roller is $V_{dev}$=−250V.

Figure 4:
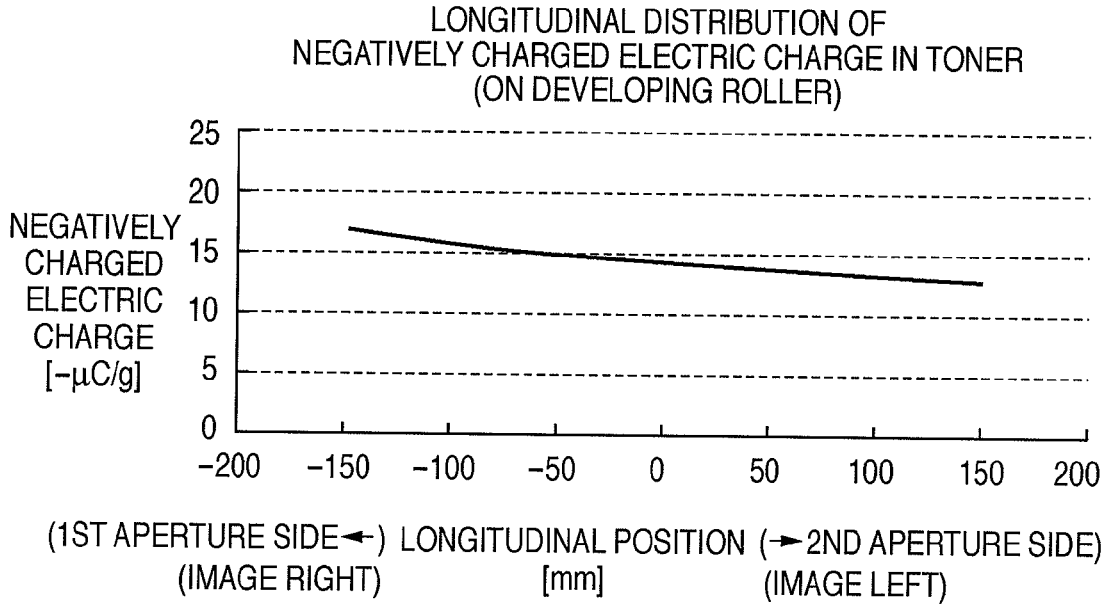
FIG. 4 shows an exemplary average amount of negatively charged electric charge.

FIG. 4 shows an exemplary average amount of negatively charged electric charge. The horizontal axis shows the position on the developing roller in the longitudinal direction (longitudinal position). The vertical axis shows the average amount of negatively charged electric charge in the toner layer formed at a corresponding longitudinal position. The longitudinal position 0 [mm] is the center of the developing roller in the longitudinal direction. In this example, it is revealed that the amount of negatively charged electric charge gradually decreases from the left end to the right end of the developing roller.

Light Power Distribution on the Photoreceptor

Next, the light amount distribution on the photosensitive drum will be described in the case where laser exposure by the laser exposure device 13 is performed. Here, study results for two types of light amount distribution will be described as Study 1 and Study 2 for comparative purposes. Note that the amount of light may be called as light quantity, light intensity or light power.

Study 1: Invention Not Applied

Figure 5:
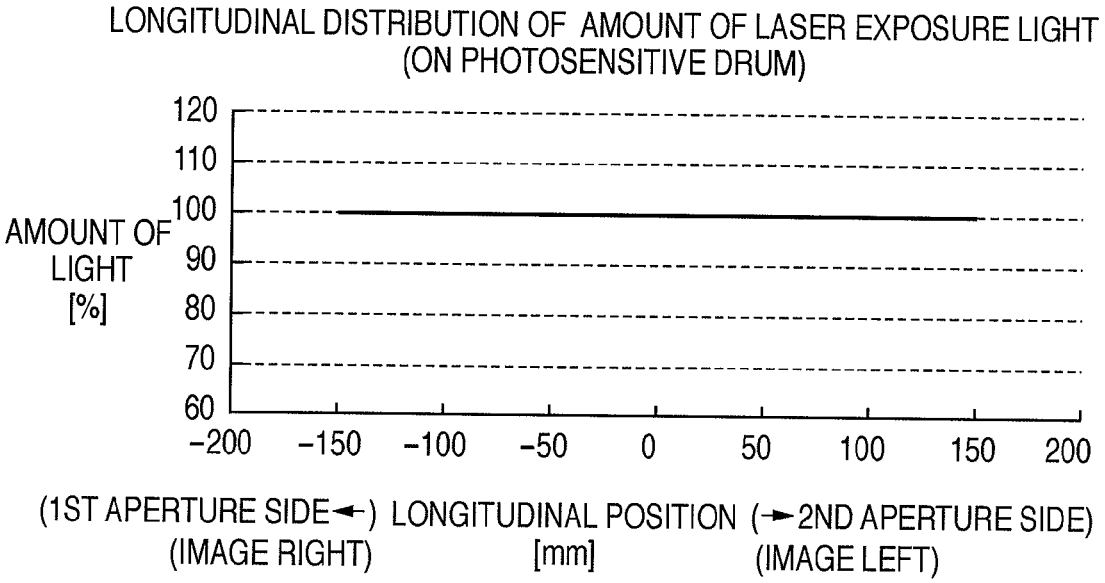
FIG. 5 shows a longitudinal distribution of amount of light from laser exposure in a Study 1.

FIG. 5 shows a longitudinal distribution of amount of light from laser exposure in Study 1. The horizontal axis shows the longitudinal position on the photosensitive drum. The vertical axis shows the amount of light from laser exposure at a corresponding longitudinal position. Longitudinal positions on the photosensitive drum 11 correspond to longitudinal positions on the developing roller. With the amount of light from laser exposure, amount of light at full illumination (0.3 μJ/cm$^2$) is defined as 100%. At full illumination, the potential on the photosensitive drum surface alters from charging potential VD=−400V to exposure potential VL=−100V. Full illumination corresponds to a laser exposure operation performed in the image-forming apparatus 100 when the image signal of an image with the highest image density that has not undergone halftone image processing, in other words, a 100% density image (solid image), is sent to the exposure apparatus. As shown in FIG. 5, the longitudinal distribution of amount of laser exposure light in Study 1 is a uniform light amount distribution on the photosensitive drum surface. Note that the spot diameter of the laser on the photosensitive drum is around 62 μm×77 μm.

Figure 6:
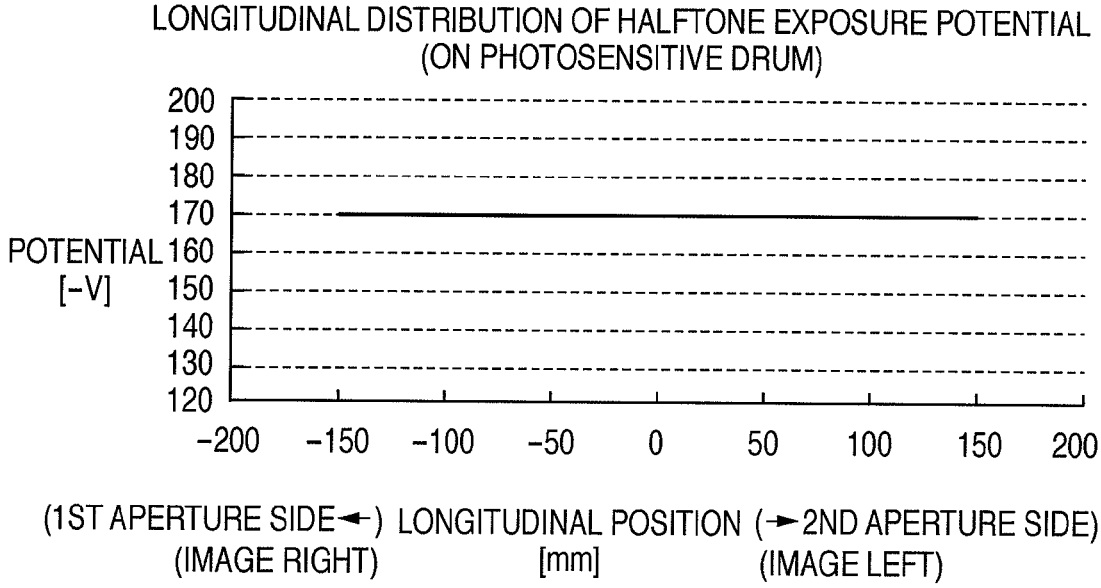
FIG. 6 shows a potential distribution formed on a photosensitive drum as the result of a laser exposure operation performed when an image signal of a halftone image (70% density) is sent.

FIG. 6 shows a potential distribution formed on the photosensitive drum as a result of a laser exposure operation performed when the image signal of a halftone image (70% density) is sent. FIG. 6 reveals that the distribution of exposure potential is uniform ($V_{ht}$=−170V) in the longitudinal direction. Uniform here means that the distribution need only be approximately uniform, rather than necessarily being perfectly uniform. As for the light amount distribution, amount of light of approximately 70% of the amount of light shown in FIG. 5 is approximately uniformly distributed in the longitudinal direction.

Figure 7:
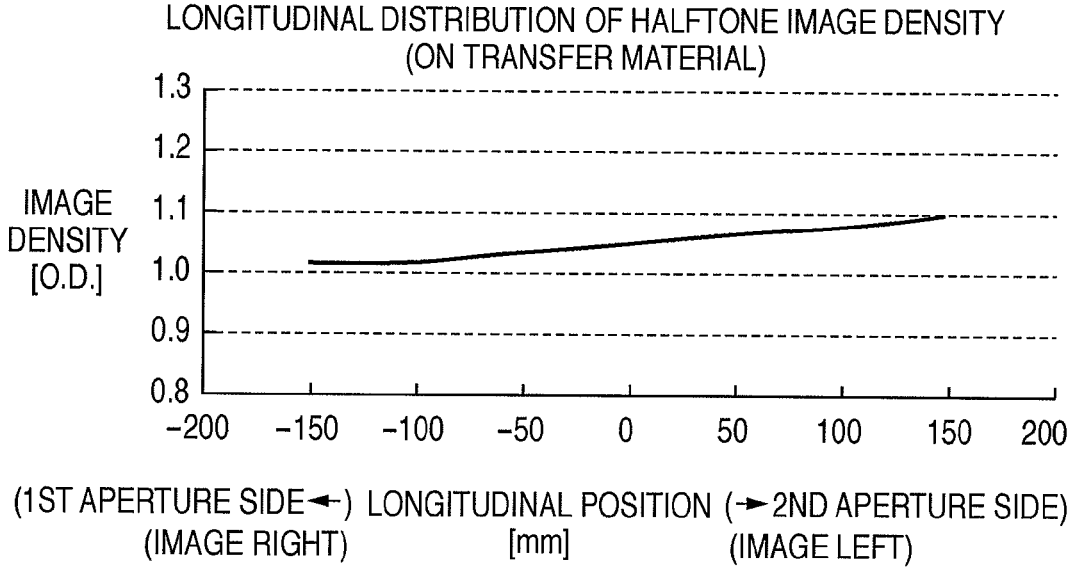
FIG. 7 shows a longitudinal distribution of halftone image density obtained on a transfer material.

FIG. 7 shows a longitudinal distribution of halftone image density obtained on transfer material. The horizontal axis shows the longitudinal position on the transfer material. The vertical axis shows the actual image density at a corresponding longitudinal position. Longitudinal positions on the transfer material also correspond to longitudinal positions on the photosensitive drum and the developing roller. The first aperture side corresponds to the right edge of the image on the transfer material, and the second aperture side corresponds to the left edge of the image.

The image densities shown in FIG. 7 were obtained by digitizing measurements taken of an image printed on Canon CLC paper (smooth paper with 80 g/m$^2$ basis weight) with a Macbeth Densitometer RD-918. FIG. 7 reveals that the image densities form a nonuniform density distribution in the longitudinal direction. Under normal circumstances, the distribution should be uniform, but instead density increases from right to left on the image (left to right on the graph). The reasons for this are as follows.

Figure 8:
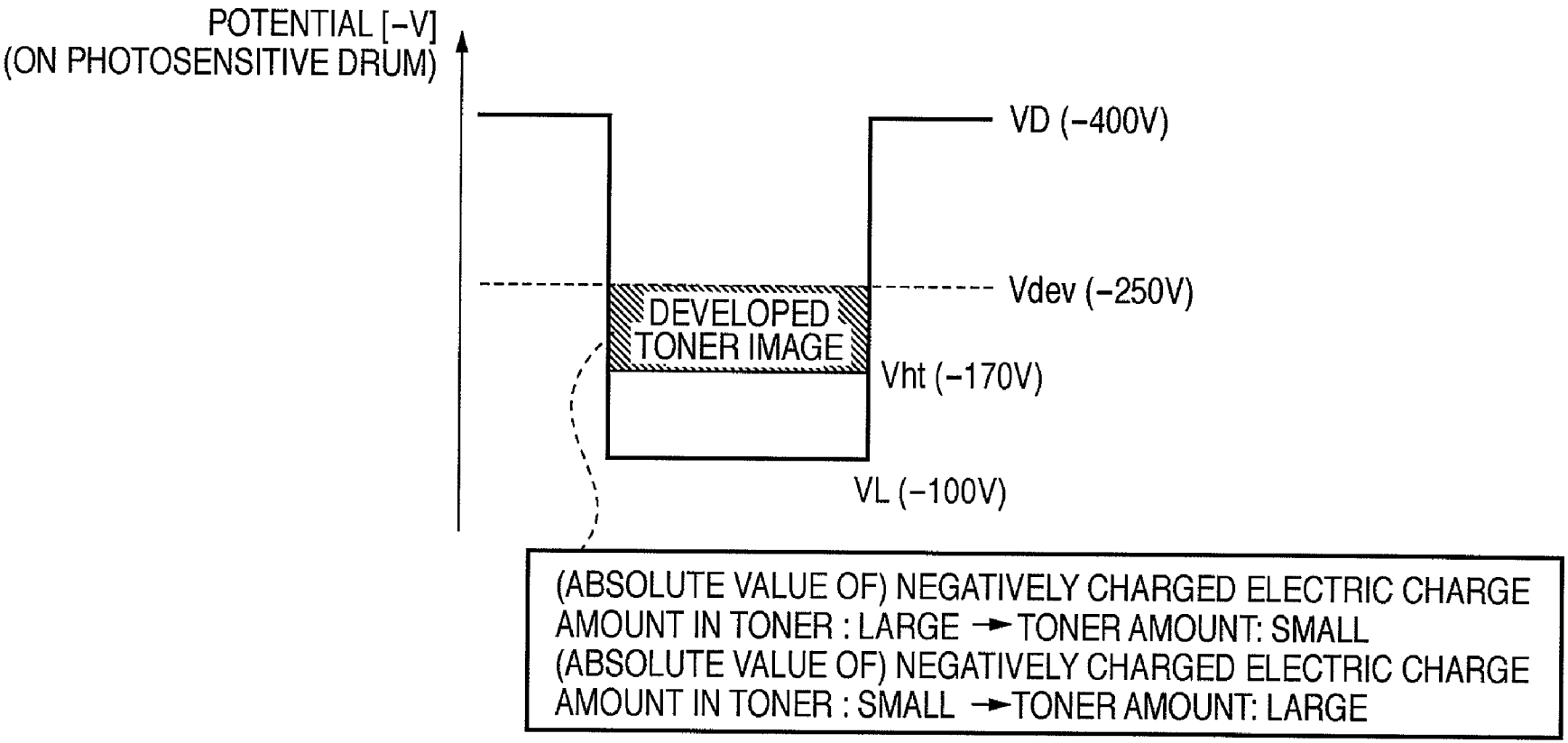
FIG. 8 schematically shows a toner image developed in a halftone exposure potential portion.

FIG. 8 schematically shows a toner image developed in a halftone exposure potential portion. Note that FIG. 8 also shows the relation between the charging potential (VD=−400V), the halftone exposure potential ($V_{ht}$=−170V) and the developing voltage ($V_{dev}$=−250V) on the photosensitive drum.

In the charging potential portion on the photosensitive drum, the toner image is not developed in a portion (non-exposure portion) where (the absolute value of) the charging potential is greater than (the absolute value of) the developing voltage $V_{dev}$. On the other hand, in the halftone exposure potential portion, the toner image is developed since (the absolute value of) the halftone exposure potential $V_{ht}$ is less than (the absolute value of) the developing voltage $V_{dev}$. The amount of toner developed in this process is dependent on the amount of negatively charged electric charge in the toner. In other words, if there is a large amount of negatively charged electric charge in the toner, not much toner will be needed to make up the difference between the exposure potential and the developing voltage. In contrast, if there is a small amount of negatively charged electric charge in the toner, a relatively large amount of toner will be needed to make up the same difference.

Accordingly, with the system of the present study, the amount of toner used in developing is relatively small at the end of the photosensitive drum corresponding to the first aperture side where there is a large amount of negatively charged electric charge in the toner on the developing roller, and image density on the transfer material is low. Also, the amount of toner is relatively large at the other end corresponding to the second aperture side where there is a small amount of negatively charged electric charge in the toner, and image density on the transfer material is high. Thus, longitudinal nonuniformity (gradient) in density occurs from the first aperture side to the second aperture side.

Study 2: Invention Applied

Figure 9:
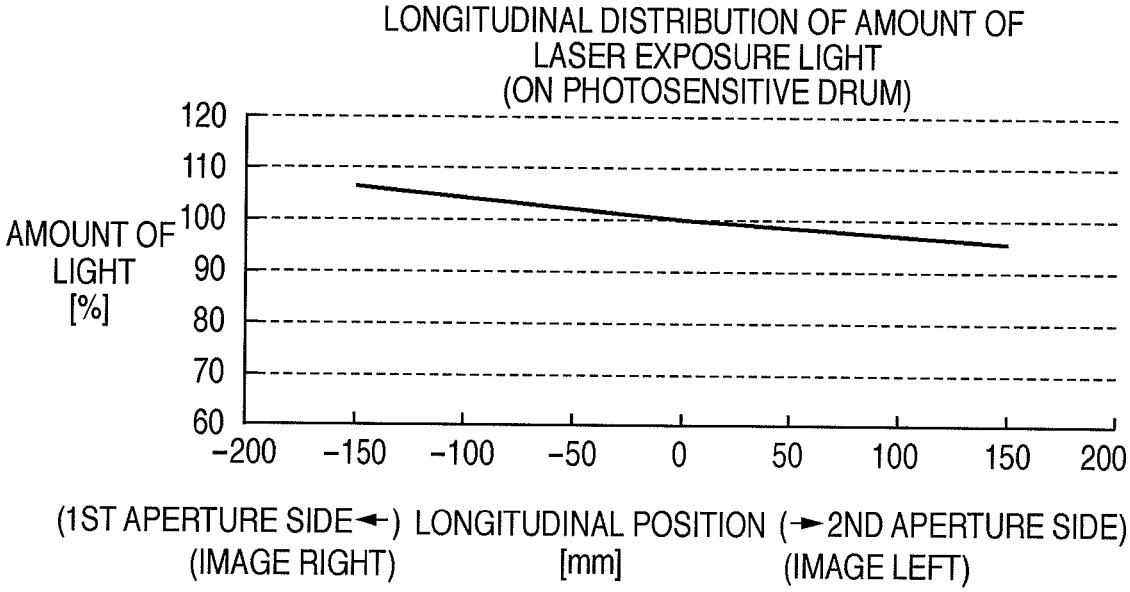
FIG. 9 shows a longitudinal distribution of amount of light from laser exposure in a Study 2.

FIG. 9 shows a longitudinal distribution of amount of light from laser exposure in Study 2. As revealed in comparison with FIG. 5, the amount of light irradiated onto the photoreceptor in the center of the photosensitive drum in the longitudinal direction is 100%, the same as Study 1. However, the amount of light irradiated on the end portion corresponding to the first aperture side of the developing roller gradually increases. Also, the amount of light irradiated on the end portion corresponding to the second aperture side gradually decreases.

Figure 10:
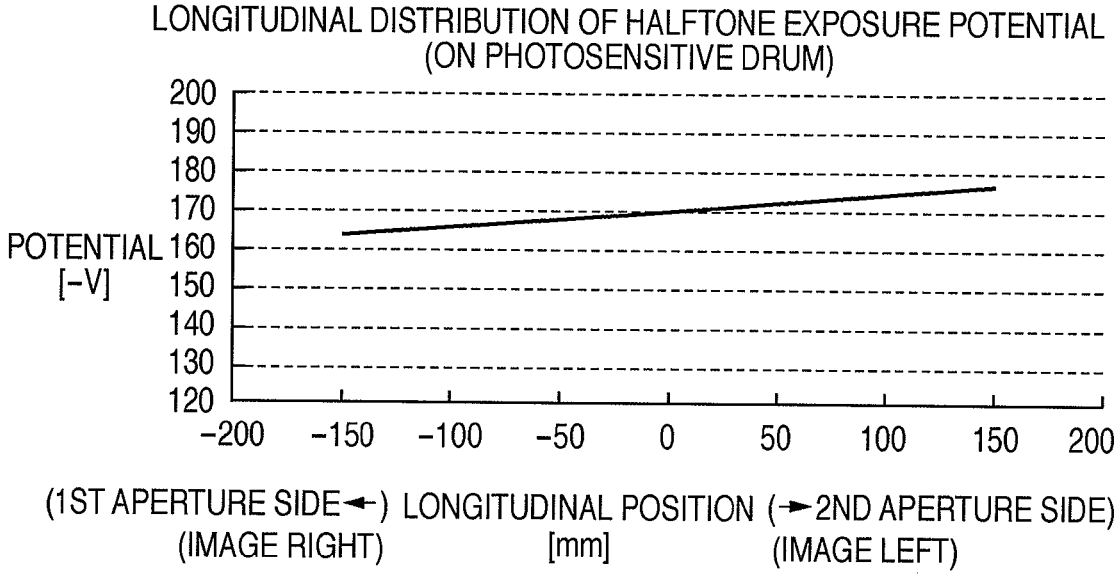
FIG. 10 shows a longitudinal distribution of exposure potential on a photosensitive drum when exposed (amount of light=70%) with the amount of light characteristics shown in FIG. 9.

FIG. 10 shows a longitudinal distribution of exposure potential on the photosensitive drum when exposed (central amount of light in the longitudinal direction=70%) with the amount of light characteristics shown in FIG. 9. The (absolute value of the) exposure potential gradually decreases from the center to the first aperture side. The (absolute value of the) exposure potential gradually increases from the center to the second aperture side. At the longitudinal center, (the absolute value of) the potential ($V_{ht}$=−170V) is the same as the exposure potential of Study 1 shown in FIG. 6.

Figure 11:
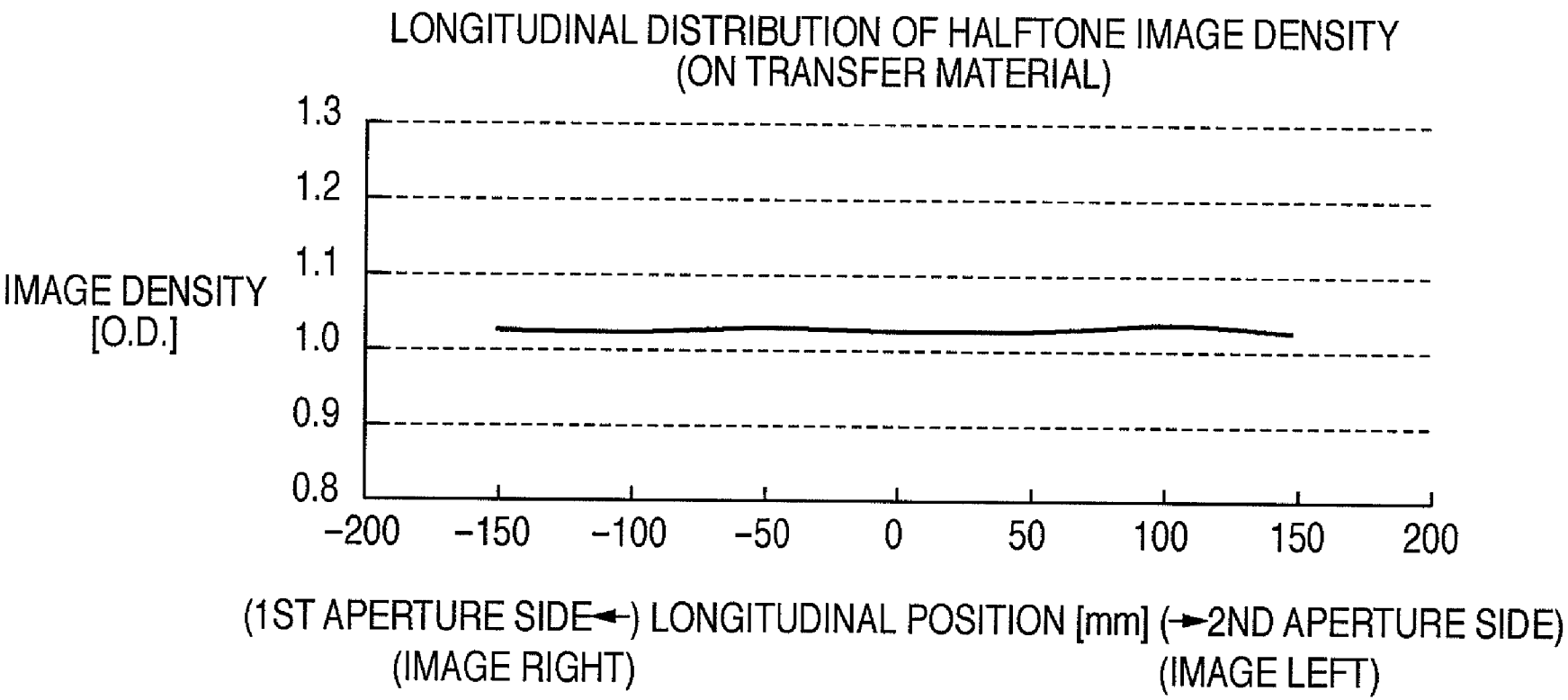
FIG. 11 shows a longitudinal distribution of image density obtained on a transfer material when exposed (amount of light=70%) with the amount of light characteristics shown in FIG. 9.

FIG. 11 shows a longitudinal distribution of image density obtained on the transfer material when exposed (central amount of light in the longitudinal direction=70%) with the amount of light characteristics shown in FIG. 9. Compared with FIG. 7, FIG. 11 reveals that the longitudinal density distribution is largely uniform. The reasons for this are as follows.

As mentioned in Study 1, the toner image is developed in the exposure potential portion, which is the portion of the photosensitive drum surface that is exposed, because (the absolute value of) the halftone exposure potential $V_{ht}$ is less than (the absolute value of) the developing voltage $V_{dev}$. With the system of Study 2, the amount of light is gradually decreased from the end of the photosensitive drum corresponding to the first aperture side of the developing roller to the other end of the photosensitive drum corresponding to the second aperture side, so as to cancel the fluctuation in image density (FIG. 7) caused by a difference in the charging characteristics of the developing-material. The absolute value of the exposure potential thus gradually rises from one end of the photosensitive drum to the other. As a result, image density will be uniform from one end of the photosensitive drum to the other.

This reveals that the fluctuation in image density caused by a difference in the charging characteristics of the developing-material is thus mitigated by using amount of light from laser exposure to realize reverse characteristics to the charging characteristics from the upstream side to the downstream side in the carrying direction of the toner. Note that the "reverse characteristics", rather than needing to be completely reverse characteristics, need only be reverse characteristics to extent that they mitigate the fluctuation in image density, that is, to the extent that they mitigate density fluctuation in comparison with when the control of the present embodiment is not implemented.

Detailed Description of Laser Exposure Device

The laser exposure device 13 will be described in detail next. The exposure device may also be referred to as a scanning optical apparatus, an optical scanning apparatus or an optical scanner apparatus. The under-filled scanner (UFS) system and the over-filled scanner (OFS) are known laser scanning optical systems. The physical size of the polygonal mirror (rotating polygonal mirror) in the OFS system is relatively small compared with the UFS system.

With the UFS system, the length of the deflection surface of the polygonal mirror in the scanning direction is longer than the width of the incident light beam. Generally, with the UFS system, longitudinal amount of light on the photosensitive drum surface is substantially uniform, since the entire width of the light beam incident on the polygonal mirror is reflected.

On the other hand, with the OFS system, only part of the width of the light beam incident on the polygonal mirror is reflected, since the length of the deflection surface of the polygonal mirror in the scanning direction is shorter than the width of the incident light beam. Consequently, with the OFS system, the width of the reflected light beam is altered by the angle of incidence of the beam, and longitudinal amount of light on the photosensitive drum surface will not be uniform. More specifically, nonuniformity (fluctuation) in the light amount distribution is caused by the angle between the deflection surface and the light beam emitted from a laser 1200, giving rise to nonuniformity (fluctuation) of an upwardly convex light amount distribution due to amount of light increasing in a medial/inner portion between two edge portions in the main scanning direction. However, the OFS method is superior in terms of increasing the speed and definition of an image-forming apparatus, since the number of revolutions of the polygonal mirror can be decreased in comparison with the UFS system, and rendering speed can also be raised. In the present embodiment, an OFS exposure device having an amount of light correction unit that is able to arbitrarily change the amount of light of the laser will be described.

Figure 12:
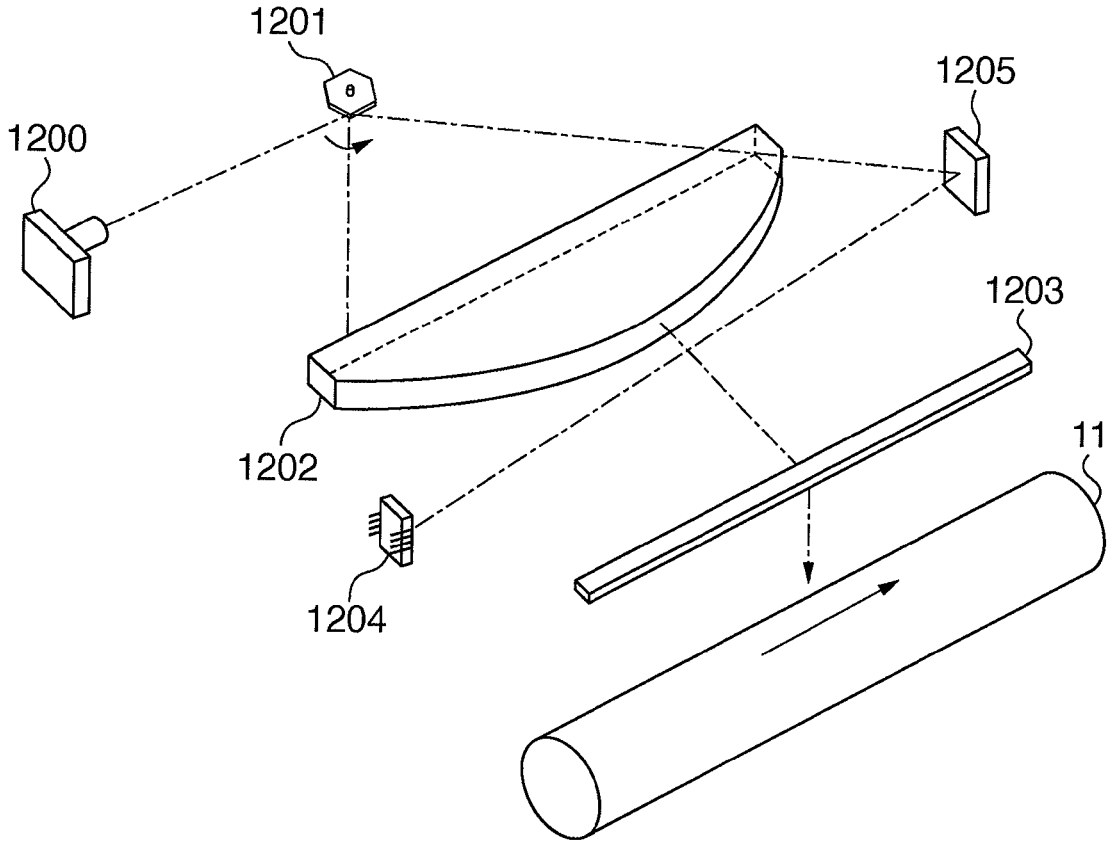
FIG. 12 shows an exemplary laser exposure device.

FIG. 12 shows an exemplary laser exposure device. A semiconductor laser (hereinafter, laser) 1200 is an exemplary light source. The laser 1200 functions as a laser emitting unit that emits light as a result of a video signal from a video controller or a control signal from an engine controller (not shown) to irradiate a beam (laser beam).

A polygonal mirror 1201 is an exemplary rotating polygonal mirror. The polygonal mirror 1201 is rotated in the direction of the arrow in FIG. 12 by a motor (not shown), and reflects and scans the beam from the laser. The motor that rotates the polygonal mirror 1201 is controlled by acceleration and deceleration signals from the engine controller (not shown) so as to maintain a constant rotation speed. The beam from the laser 1200 scans over the photosensitive drum 11 in the direction of the arrow, via an fθ lens 1202 and a reflex mirror 1203. The fθ lens 1202 is an optical component for scanning the beam over the photosensitive drum 11 at a uniform speed.

A BD 1204 is an element that performs light-to-voltage conversion. BD is short for beam detection. The beam reflected by a mirror 1205 provided on the beam scanning path is incident on the BD 1204 at a prescribed timing. The BD 1204 generates a BD signal using a voltage produced by the incident light, and outputs the BD signal to a CPU or a logic circuit in the engine controller (not shown). The BD signal is used as a horizontal synchronization signal.

Figure 13:
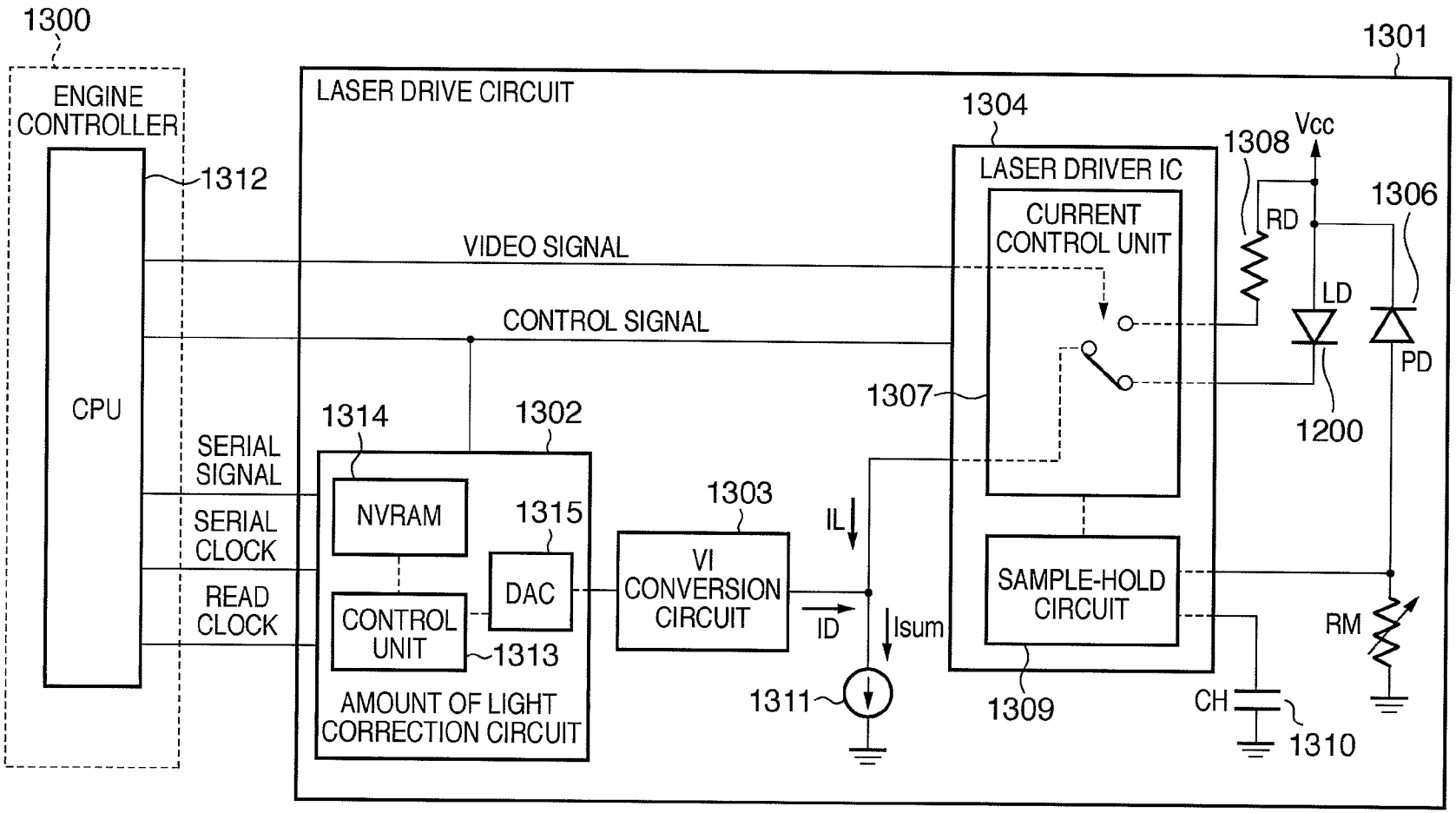
FIG. 13 shows an exemplary laser drive circuit and an exemplary engine controller that are involved in amount of light correction control according to a preferred embodiment.

FIG. 13 shows an exemplary laser drive circuit and an exemplary engine controller that are involved in amount of light correction control according to the present embodiment. An engine controller 1300 is a control unit that has a CPU 1312. A laser drive circuit 1301 is provided with an amount of light correction circuit 1302, a VI conversion circuit 1303, a laser driver IC 1304, the laser 1200, and a photodiode 1306.

A current control unit 1307 in the laser driver IC 1304 switches between causing the laser 1200 to emit light by conducting current thereto, and feeding current to a dummy resistor 1308 to turn off the laser 1200, according to a video signal.

Sampling control will be described next. Sampling control is executed when the laser exposure device is started up and for every image-forming scan. When the laser 1200 is driven and emits light, part of the light emitted from the laser 1200 is incident on the photodiode 1306. At this time, a photocurrent proportional to the amount of emitted light of the laser 1200 is output by the photodiode 1306, and input to a sample-hold circuit 1309. The value of the photocurrent is sampled by the sample-hold circuit 1309 and output to the current control unit 1307. The current control unit 1307 compares the output signal from the sample-hold circuit 1309 with the required amount of light. If the output signal (amount of emitted light) is lower than the required amount of light, the current control unit 1307 increases the drive current to the laser. On the other hand, if the amount of emitted light is higher than the required amount of light, the current control unit 1307 performs a control to reduce the laser current. When the amount of laser light reaches a prescribed amount of emitted light, the sample-hold circuit 1309 is held. Holding the output value at this time as a voltage value in a condenser 1310 connected to the sample-hold circuit 1309 enables the laser 1200 to emit light at a prescribed amount of light for each scan.

A current $I_{sum}$ flowing to a constant current circuit 1311 is set by the VI conversion circuit 1303 so that the amount of light detected by the photodiode 1306 reaches a prescribed amount of light. A control unit 1313 in the amount of light correction circuit 1302 is connected by serial communication to the CPU 1312 of the engine controller 1300. The CPU 1312 of the engine controller 1300 transmits information such as the print mode to the control unit 1313 of the amount of light correction circuit 1302.

The amount of light correction circuit 1302 has a nonvolatile storage unit NVRAM 1314, and stores a correction profile based on each beam's amount of light profile. In the correction profile is stored a laser current correction value for each beam scanning position obtained when the beam scanning length on the photosensitive drum surface is divided by a prescribed value. After a prescribed time period from when a control signal was input from the CPU 1312 in synchronous with the BD signal, the control unit 1313 of the amount of light correction circuit 1302 starts reading out current correction values from the correction profile stored in the NVRAM 1314. The readout timing is a read clock output from the CPU 1312 of the engine controller 1300. The frequency of the read clock is determined according to the division number of the beam scanning length.

The control unit 1313 of the amount of light correction circuit 1302 converts a read current correction value of the correction profile to a prescribed analog voltage value using a digital-to-analog (D/A) converter 1315 built into the amount of light correction circuit 1302. The analog voltage output from the amount of light correction circuit 1302 is converted to correction current ID in the VI conversion circuit 1303, and fed to the constant current circuit 1311. Consequently, a laser current IL is obtained by subtracting the correction current ID output from the VI conversion circuit 1303 from the set current $I_{sum}$ flowing to the constant current circuit 1311. The computation equation is, for example, $$IL=I_{sum}-ID \tag{1}$$

Figure 14:
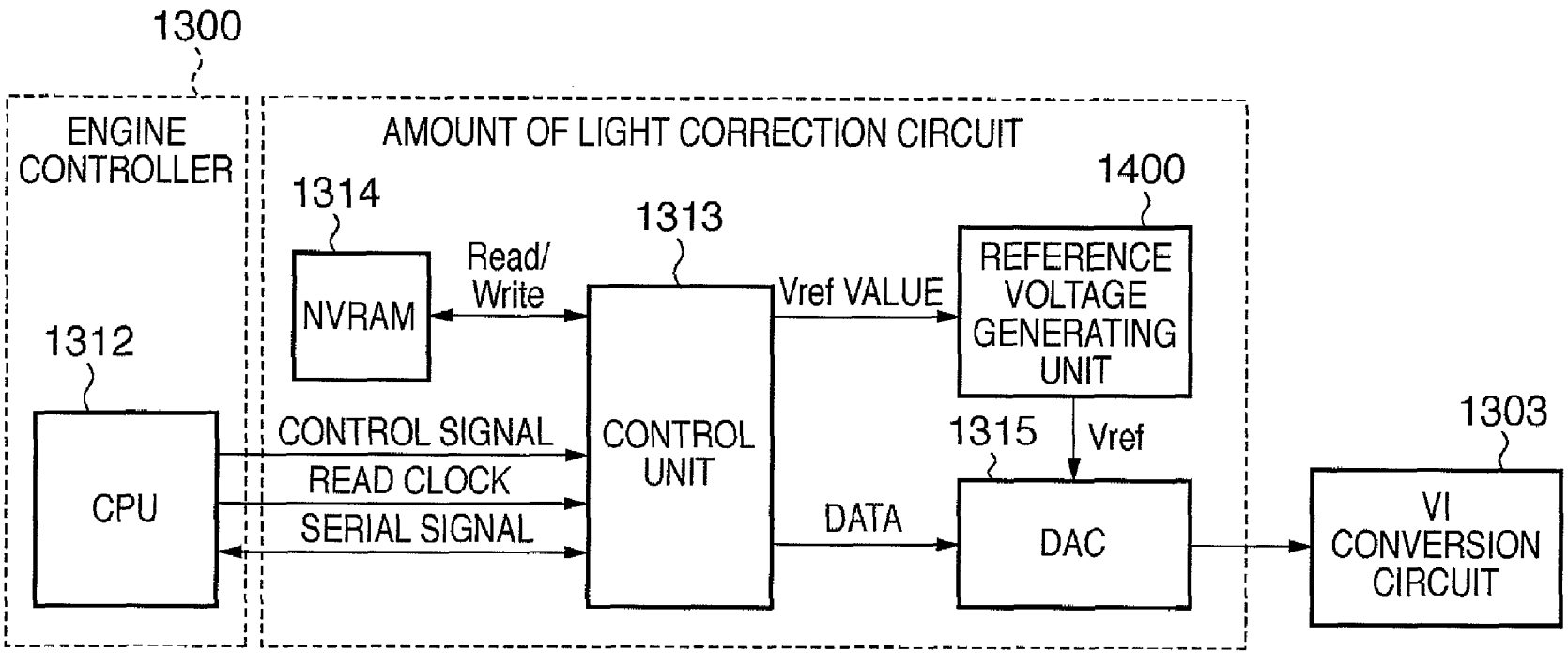
FIG. 14 shows an exemplary block diagram of an amount of light correction circuit.

FIG. 14 is a block diagram showing the amount of light correction circuit 1302 in detail. The NVRAM 1314 is a nonvolatile storage unit. The control unit 1313 is provided with a logic circuit. The D/A converter 1315 performs D/A conversion on multi-value data read out from the NVRAM 1314 and outputs an analog voltage. The VI conversion circuit 1303 converts the analog voltage output from the D/A converter to a current. The CPU 1312 performs a central role in controlling the engine controller.

The control unit 1313 is connected to the NVRAM 1314, and is able to read out and write data stored in the NVRAM 1314. The CPU 1312 is able to read out and write data stored in the NVRAM 1314 via serial communication with the control unit 1313. The control unit 1313 reads out a $V_{ref}$ value (reference voltage of D/A converter 1315) stored in the NVRAM 1314, and sets the $V_{ref}$ value in a reference voltage generating unit 1400. The reference voltage generating unit 1400 outputs a voltage equivalent to the $V_{ref}$ value to the D/A converter 1315. The control unit 1313 reads out correction profile data from the NVRAM 1314 and sets the correction profile data in the D/A converter 1315, with the control signal synchronized with the BD signal that is received from the CPU 1312 of the engine controller as a trigger signal. The D/A converter 1315 outputs to the VI conversion circuit 1303 a voltage value obtained by multiplying the correction profile data with the voltage equivalent to the $V_{ref}$ value.

Note that in the following, the $V_{ref}$ value will be described separately from the correction profile data to facilitate understanding. However, given that the amount of light indicated by a reference numeral 1605 in FIG. 16 (described below), for example, is also changed depending on the size variance of the $V_{ref}$ value, the $V_{ref}$ value can effectively be interpreted as part of the correction profile data.

Figure 15:
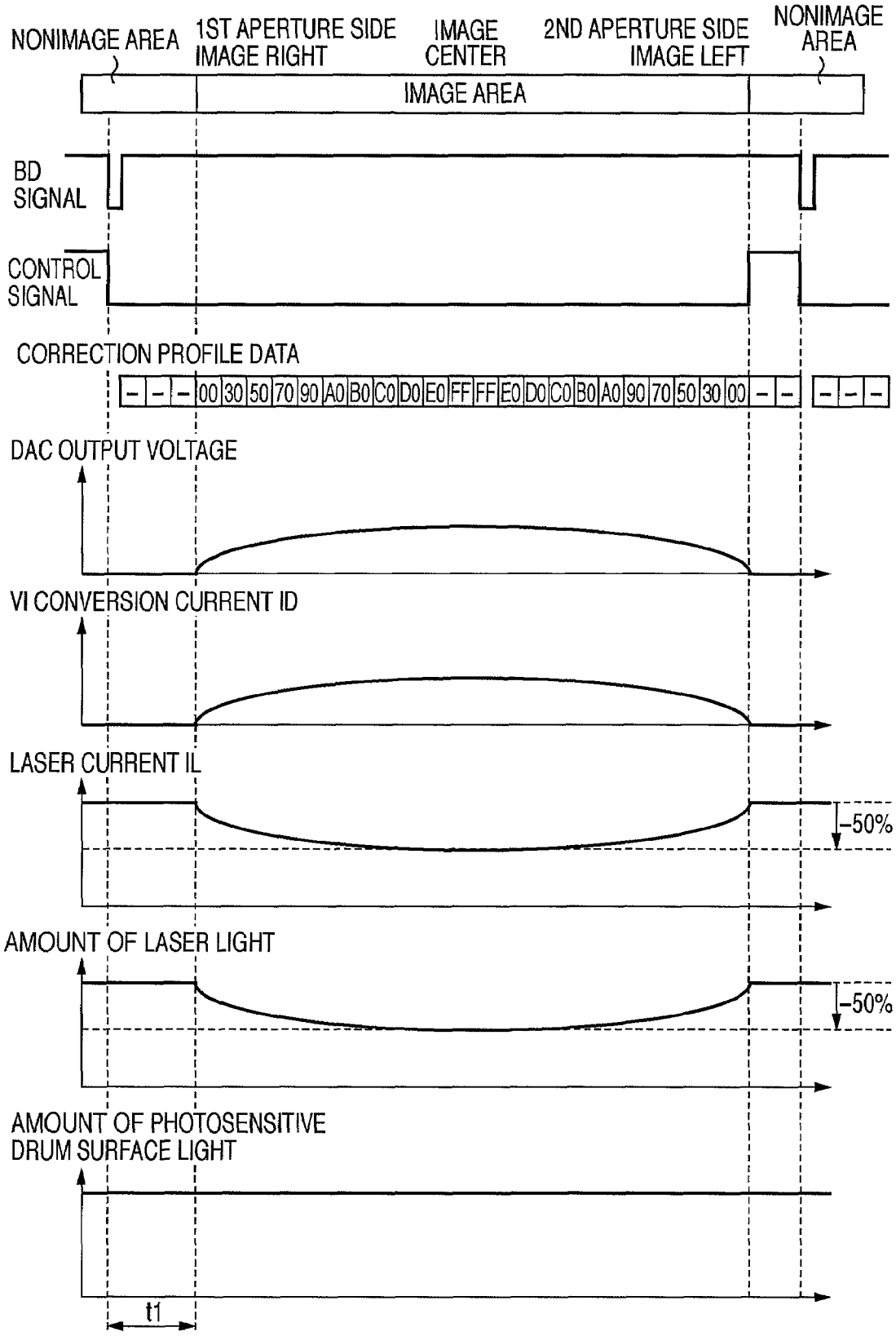
FIG. 15 is a timing chart for equalizing amount of light on the photosensitive drum surface by reducing amount of laser light in a central portion of the image by a maximum of 50% in comparison with amount of light at both edges of the image, in an OFS system.

FIG. 15 is a timing chart for equalizing amount of light on the photosensitive drum surface by decreasing amount of laser light in a central or approximately central portion of the image by a maximum of 50%, for example, in comparison with amount of light at both edges of the image in OFS system. To facilitate understanding, the density nonuniformity correction of the present invention will, in the following, firstly be described while excluding the aforementioned difference in the characteristic distribution in the longitudinal direction that occurs in the toner layer formed on the developing roller, which will be discussed in detail later using FIGS. 16 and 18. In FIG. 15, the beam scanning length is divided into 22 intervals. Note that the beam scanning length is divided into 22 intervals by way of example, and may be divided into smaller intervals. Here, the correction file data in a single interval is represented by 2 bytes, for example. Note that amount of light can be corrected more precisely the greater the number of intervals into which the beam scanning length is divided and the greater the data length of the correction profile.

Note that the correction profile data of the present embodiment determines the correction current ID for each beam scanning position. The control unit 1313 in FIG. 14 reads out the correction profile stored in the NVRAM 1314. For example, the control unit 1313 reads out 2-byte correction profile data FFh at a central or approximately central portion of the image, and sets the correction profile data FFh in the D/A converter 1315. In the case where the correction profile data is the maximum data value FFh, the reference voltage generating unit 1400 outputs a voltage equivalent to a $V_{ref}$ value predetermined so that the correction current ID will be 50% of $I_{sum}$. A voltage value obtained by multiplying the correction profile data by the voltage equivalent to the $V_{ref}$ value output by the reference voltage generating unit 1400 is output by the D/A converter 1315 to the VI conversion circuit 1303, and a correction current ID is generated. Since correction profile data is 2 bytes, the correction current ID at this time will be 50% of $I_{sum}$ in the case where the data is FFh. On the other hand, if the correction profile data is 00h, the correction current ID will be 0 mA.

The procedure for creating correction profile data for controlling the laser drive current is as follows. Firstly, measurement of photosensitive drum surface light quantity in the scanning direction is performed at a plurality of sites with amount of light correction in a non-operational state, for each laser exposure device beforehand at the factory or the like. Here, photosensitive drum surface light quantity is the amount of laser light of the beam irradiated from the laser when actually exposed on the photosensitive drum via an optical system such as an fθ lens or a reflex mirror. Next, correction profile data such that photosensitive drum surface light quantity is uniform throughout is normally created. The correction profile data is stored in the NVRAM 1314 of the amount of light correction circuit. Note that in the present embodiment, photosensitive drum surface light quantity is not made uniform throughout, since the charged electric charge distribution of the toner in the longitudinal direction of the developing container is taken into consideration, as described above. As will be discussed in detail below, photosensitive drum surface light quantity is altered to the extent that the charged electric charge distribution of the toner is taken into consideration.

On detecting a control signal output from the CPU 1312 of the engine controller in synchronous with the BD signal, the control unit 1313 of the amount of light correction circuit starts reading out correction profile data after a prescribed timing t1. Normally, since the correction profile data at both edge portions of the image is 00h, the output voltage of the D/A converter will be 0V, and the correction current ID will be 0 mA. Consequently, laser current and amount of laser light will normally be maximized in the scanning direction at the edge portions of the image.

On the other hand, the correction profile data at a central or approximately central portion of the image will normally be FFh. Consequently, the reference voltage $V_{ref}$ value of the D/A converter 1315 is preset so that amount of light decreases by 50% from the maximum amount of light. The correction current ID at a central or approximately central portion of the image will be 50% of the set current $I_{sum}$ flowing to the constant current circuit 1311, as a result of output based on multiplying the correction profile by $V_{ref}$. Nonuniformity of an upwardly convex light amount distribution due to amount of light increasing in a medial portion between the two edge portions in the main scanning direction, as characteristic of OFS, can be suppressed by the correction profile data illustrated in FIG. 15.

Figure 16:
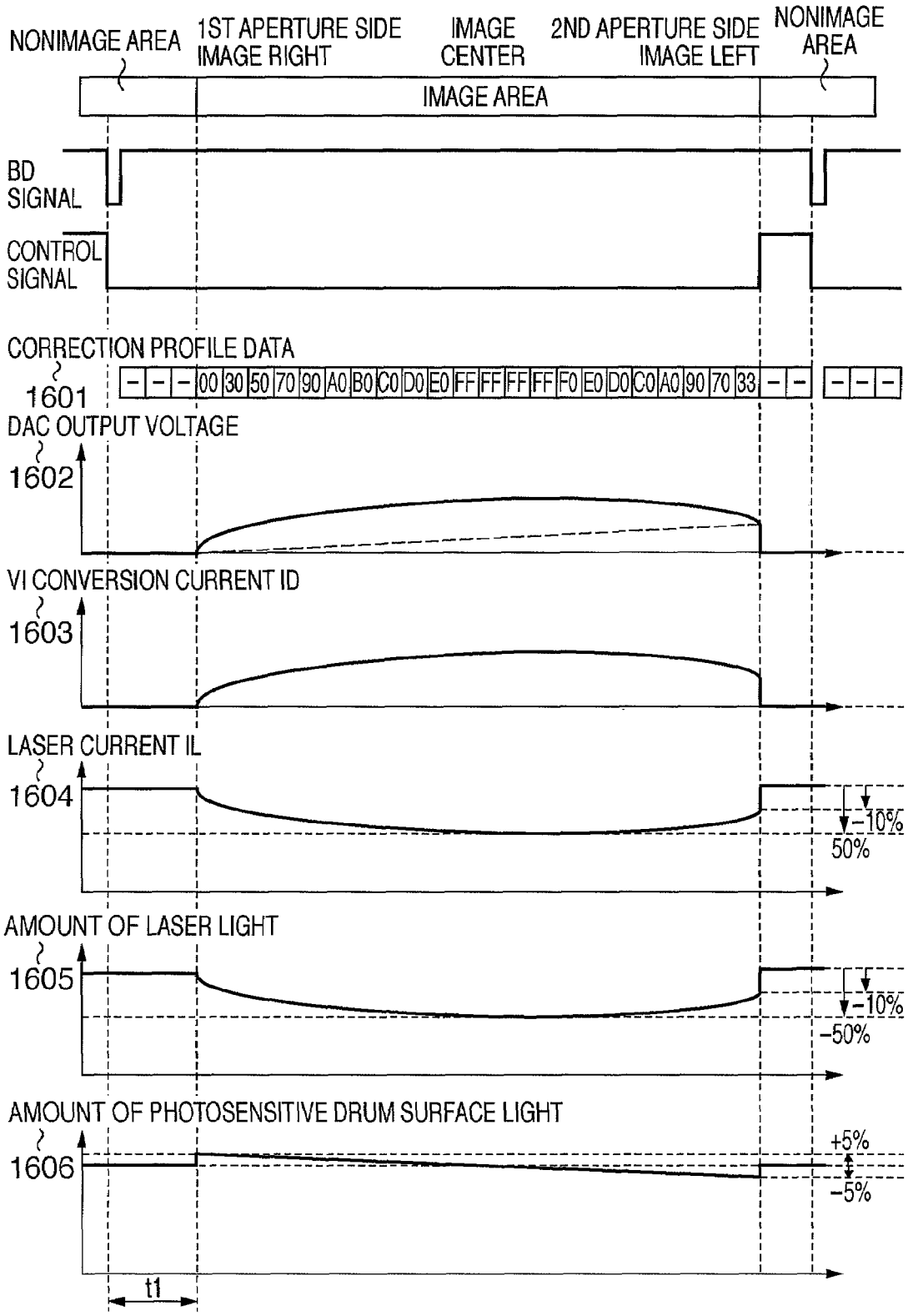
FIG. 16 is a timing chart for increasing amount of light at the right edge of the image by 5% relative to the image center and reducing amount of light at the left edge of the image by 5% relative to the image center, by linearly altering the amount of light of the photosensitive drum surface between the right and left edges of the image by 10%.

FIG. 16 is a timing chart for increasing the amount of light of the right edge of the image by approximately 5% relative to the image center, and decreasing the amount of light of the left edge of the image by approximately 5% relative to the image center.

The underlying correction profile data is determined similarly to FIG. 15. Next, correction profile data corrected so that the data values rise linearly by 10% from the right edge of the image to the left edge is created. This correction profile data is stored in the NVRAM 1314 of the amount of light correction circuit. The gradient, which is here set at 10%, is determined so as to enable an alteration in image density caused by an alteration in charging characteristics to be mitigated. In FIG. 16, a DAC output voltage 1602 is shown as increasing linearly relative to the DAC voltage in FIG. 15. However, the output amount of light of the semiconductor laser 1200 does not, strictly speaking, increase linearly in the case where it is desired to alter amount of light linearly on the photosensitive drum, given the characteristics of OFS whereby the length of the deflection surface of the polygonal mirror in the scanning direction is shorter than the width of the incident light beam. In the case where the DAC output in FIG. 16 has a small gradient, however, a substantially linear alternation in amount of light on the photosensitive drum surface is obtained for practical purposes, simply by making the increase in the correction profile of the semiconductor laser 1200 linear, when measurement system error is taken into consideration.

According to FIG. 16, correction profile data 1601 at the left edge of the image is 33h. The correction profile data in the image center is FFh, and the correction current ID (VI conversion current ID 1603) will be 50% of $I_{sum}$. Also, in FIG. 15, which exhibits no difference in amount of light on the left and right of the image, the correction profile data at the right and left edges of the image is 00h, and the correction current ID is 0 mA. On the other hand, since the correction profile data at the left edge of the image in FIG. 16 is 33h and the correction current ID will be 10% of $I_{sum}$, the actual laser current IL 1604 will be 90% of $I_{sum}$. The amount of laser light 1605 having a downwardly convex light amount distribution is realized by this laser drive current IL. At this time, with amount of laser light 1605, the width by which amount of emitted light decreases along the scanning direction is different from the width by which amount of emitted light increases. Photosensitive drum surface amount of light 1606 at the left edge of the image is approximately 10% lower than photosensitive drum surface light quantity 1606 at the right edge of the image. By correcting the correction profile data so that the data values rise linearly by 10% from the right edge of the image to the left edge, amount of light after amount of light correction increases by 5% at the right edge of the image and decreases by 5% at the left edge of the image relative to amount of light at the image center.

A printer equipped with the developing apparatus shown in FIG. 2 and an OFS laser scanning optical system is able to collectively correct nonuniformity (fluctuation) in image density caused by the following two factors contributing to density nonuniformity, using the timing chart shown in FIG. 16. (a) Nonuniformity of an upwardly convex light amount distribution due to amount of light increasing in a medial portion between two edge portions in the main scanning direction, in an OFS laser scanning optical system. (b) Difference in the charging characteristics of the toner used, from the end of the image carrier corresponding to the upstream side in the toner carrying direction to the other end of the image carrier corresponding to the downstream side in the toner carrying direction.

Figure 17:
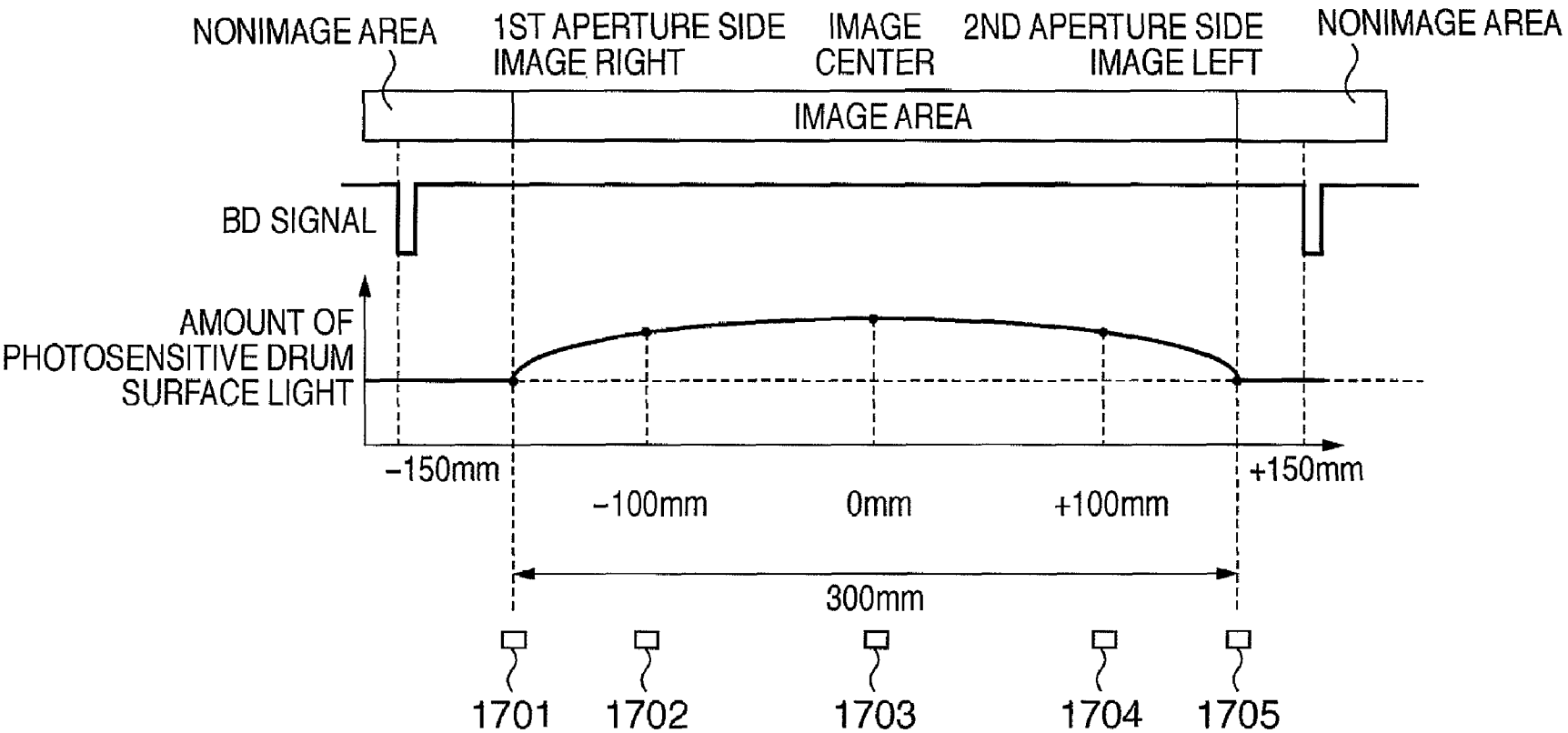
FIG. 17 shows photosensitive drum surface light quantity measuring positions for creating correction profile data in an OFS system.

FIG. 17 shows amount of light measuring positions on the photosensitive drum surface for creating correction profile data in the OFS system. When measurements are taken, amount of light correction is set so to be non-operational.

Here, the background and thinking behind setting the difference in amount of light between the right and left portions of the image to 10% will be outlined below, using the flowchart of FIG. 18.

(i) Firstly, because we want to make the amount of light of the left portion of the image 10% lower than the amount of light of the right portion, we need only to increase the correction current (ID in FIG. 13) of the left portion of the image by 10% relative to the right portion of the image, given that $IL=I_{sum}-ID$ (Equation 1).

Figure 18:
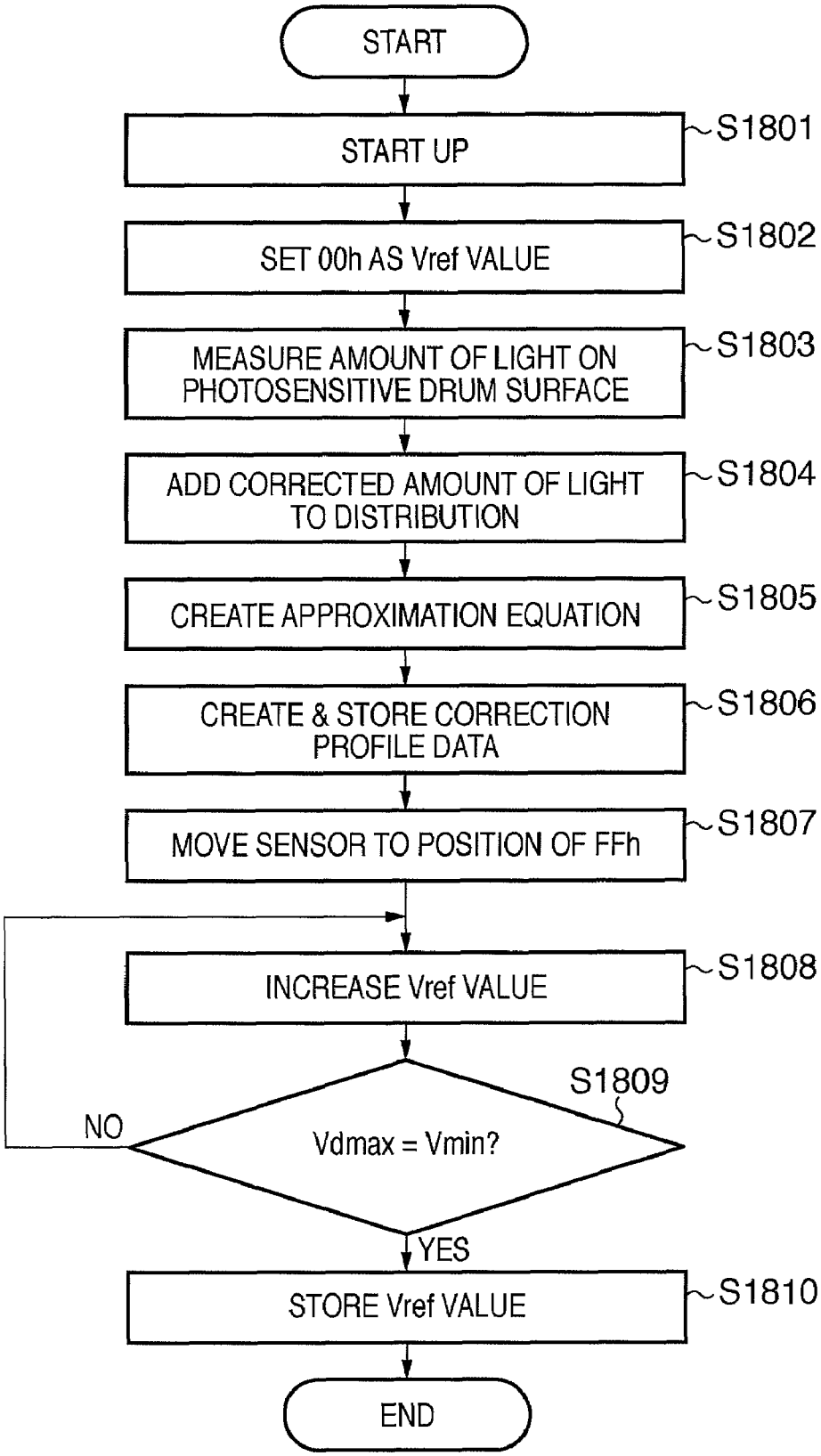
FIG. 18 is a flowchart showing an exemplary method of setting correction profile data and a DAC reference voltage $V_{ref}$ value.

(ii) In the flowchart of FIG. 18, the measured amount of light of the left portion of the image is artificially set to 10% more than the measured amount of light of the right portion of the image, in order to execute (i) above. Because the measured current is thus large, a correction profile is set that weakens the resultant light beam intensity by 10% so as to reduce amount of light by 10%. This will now be described in detail.

FIG. 18 is a flowchart showing an exemplary method of setting correction profile data and the DAC reference voltage $V_{ref}$ value.

(Step S1801)

At step S1801, the CPU 1312 starts up the laser exposure device 13, and causes the laser 1200 to perform full light-emission in the image area.

(Step S1802)

At step S1802, the control unit 1313 sets 00h as the $V_{ref}$ value in the reference voltage generating unit 1400, and thereby sets the output voltage of the D/A converter 1315 to 0V. Since the correction current ID at this time will be 0 mA, the set current $I_{sum}$ flowing to the constant current circuit 1311 will be the laser current IL.

(Step S1803)

At step S1803, the CPU 1312 performs the amount of light measurement shown in FIG. 17 with amount of light correction in a non-operational state. In the present embodiment, amount of light is measured at five points on the photosensitive drum surface. For example, sensors 1701 to 1705 are installed in five places, namely, 0 mm, ±100 mm and ±150 mm with respect to an image area of 300 mm, with the center of the image width being 0 mm. The more sensors for measuring amount of light on the photosensitive drum surface there are installed, the greater the precision with which the correction profile can be created.

(Step S1804)

At step S1804, the CPU 1312 increases or decreases the sensor output voltage values. More specifically, the CPU 1312 decreases the voltage value output by the sensors at −150 mm on the right edge of the image by 5%, and increases the voltage value output by the sensors at +150 mm on the left edge of the image by 5%. The CPU 1312 then determines a linear equation, Equation (2), so that the sensor output voltage is neither increased nor decreased at 0 mm in the center, is decreased by 5% at −150 mm, and is increased by 5% at +150 mm.

$$mx+n \tag{2}$$

Here, the variable x is a beam scanning position obtained when the beam scanning length is divided by a prescribed value.

Further, the CPU 1312 adds (reflects) the values derived from the linear equation determined by Equation (2) to the values actually measured for the five places in the longitudinal light amount distribution on the photosensitive drum surface, and obtains measurement results after correction.

In the present embodiment, amount of light is gradually decreased from the end of the photosensitive drum corresponding to the first aperture side of the developing roller to the other end of the photosensitive drum corresponding to the second aperture side, so as to cancel the fluctuation in image density (FIG. 7) caused by the difference in the charging characteristics of the developing-material.

In the case where only the nonuniformity of the upwardly convex light amount distribution on the drum surface caused by the OFS system is corrected, as illustrated in FIG. 15, the image density slope caused by the charged amount of the developing-material is not taken into consideration since the correction profile is generated using the results of measuring amount of light on the drum surface.

In view of this, amount of light on the drum surface corresponding to the image density slope caused by the charged amount of the developing-material is added to or subtracted from the results obtained by measuring amount of light on the drum surface when only light amount distribution nonuniformity caused by the OFS system is corrected. In this manner, correction is made by determining correction profile data that equalizes the light amount distribution.

Then, at step S1805, a correction profile is determined for correcting the upwardly convex light amount distribution obtained after reflecting the density gradient resulting from the toner charging characteristics in the nonuniformity of the upwardly convex light amount distribution in which the toner charging characteristics have not been taken into account such as shown in FIG. 17. More specifically, the alteration in the sensor output voltage values at beam scanning positions obtained when the beam scanning length is divided by a prescribed value is approximated with a quartic equation, Equation (3), based on the measurement results after correction.

$$ax^4+bx^3+cx^2+dx+e \tag{3}$$

Further, the quartic approximation derived by Equation (3) is used to determine the sensor output voltage values at the beam scanning positions from the derived quartic approximation.

(Step S1806)

At step S1806, the CPU 1312 creates correction profile data from the quartic approximation, and stores the correction profile data in the NVRAM 1314. Firstly, the CPU 1312 uses the aforementioned approximation equation to calculate the sensor output values at scanning positions obtained when the beam scanning length is divided by a prescribed value. The CPU 1312 sets the maximum voltage value to FFh and the minimum voltage value to 00h, out of the sensor output values at the scanning positions. Further, the CPU 1312 divides the difference voltage between the minimum voltage value and the minimum voltage value by 255, and converts the sensor output values of the scanning positions to 2-byte data values. The correction profile data of the scanning positions thus created is stored in the NVRAM 1314. An alteration in correction current ID similar to the form of the quartic approximation derived at step S1805 can be realized using output obtained by multiplying this correction profile data by $V_{ref}$ which is determined subsequently.

(Step S1807)

At steps S1807 to S1809, processing is performed to determined the $V_{ref}$ value whereby amount of light at the place where the correction amount is greatest will be the same as the amount of light of the left portion in the case where amount of light correction is not performed (corresponds to the output voltage of the sensors).

As defined by $IL=I_{sum}-ID$ (Equation 1), the correction amount (ID) needs to be increased to reduce amount of light. Because the correction amount (ID) is determined by output based on multiplying the correction profile data (FFh in this case) by $V_{ref}$, it is determined what $V_{ref}$ should be to obtain the required correction amount.

At step S1807, the CPU 1312 moves one sensor to the scanning position where the data value is FFh, out of the correction profile data of the scanning positions.

(Step S1808)

At step S1808, the CPU 1312 increases the $V_{ref}$ value from 00h by a prescribed value, and sets the result in the reference voltage generating unit 1400.

(Step S1809)

At step S1809, the control unit 1313 judges whether the maximum sensor output value $VD_{max}$ is equal to the minimum voltage value $V_{min}$. Note that the minimum voltage value $V_{min}$ is the minimum value out of the sensor output values at the scanning positions. The maximum sensor output value $VD_{max}$ is the sensor output value detected by the moved sensor. If $VD_{max} \neq V_{min}$, the processing returns to step S1808, where the $V_{ref}$ value is further increased by the prescribed value.

Finally, when $VD_{max}=V_{min}$, the processing proceeds to step S1810, where the control unit 1313 stores the $V_{ref}$ value at this time in the NVRAM 1314.

The correction profile saved in the NVRAM 1314 at step S1806 is the correction profile data 1601 in the timing chart of FIG. 16. Voltage values obtained by multiplying the correction profile data 1601 by the $V_{ref}$ value stored in the NVRAM 1314 at step S1810 will be the DAC output voltage 1602.

The correction profile data value at the scanning position where the sensor output value is $V_{min}$ is 00h, and the correction current ID at this time will be 0 mA. Therefore, the set current $I_{sum}$ flowing to the constant current circuit 1311 will be the laser current IL. On the other hand, the correction current ID will be maximized during a single beam scanning cycle at the scanning position where the correction profile data value is FFh. Therefore, the laser current IL will be minimized.

According to the present embodiment, by correcting fluctuation in image density caused by a difference in the charging characteristics of the developing-material, the occurrence of image defects such as density nonuniformity is suppressed and a favorable image is obtained, even in a state where newly replenished developing-material is mixed with deteriorated developing-material.

That is, in an image-forming apparatus that employs a toner replenishing system, fluctuation in image density caused by a difference in charging characteristics readily occurs when toner is supplied to the developing roller while being carried along the developing roller using a toner carrying screw that is parallel to the developing roller. In view of this, the laser exposure device is controlled so that amount of exposure light gradually decreases from the end of the photosensitive drum corresponding to the upstream side in the toner carrying direction to the other end of the photosensitive drum corresponding to the downstream side in the toner carrying direction. The charging characteristics are cancelled by such exposure characteristics, and the occurrence of image defects such as density nonuniformity is suppressed, allowing a favorable image to be obtained.

In the present embodiment, the charged electric charge distribution of toner in the developing apparatus is assumed to have a distribution as shown in FIG. 4. However, the charged electric charge distribution of toner may in actual fact also fluctuate according to the operating state and history (e.g., printing environment, image pattern, aggregate print count) of the image-forming apparatus (developing apparatus 14). Even if this is the case, however the effect sought by the present invention is obtained by assuming an average operating state in the image-forming apparatus, and setting the distribution of amount of laser exposure light with allowance for the charged electric charge distribution of toner that will occur in this operating state. For example, when setting the distribution of amount of laser exposure light, a plurality of gradients of amount of exposure light (correction profile data) from one end of the photosensitive drum to the other may be acquired, and the average value thereof may be used. More specifically, a plurality of fluctuations in charging characteristics are empirically acquired, the gradients of amount of exposure light corresponding to the acquired fluctuations are further acquired, and an average value is computed from the acquired plurality of gradients.

The CPU 1312 or the control unit 1313 may also function as a setting unit for setting correction profile data (equivalent to 1601 in FIG. 16) that alters the amount of light of the laser emitting unit from one end of the photosensitive drum to the other according to the operating state of the image-forming apparatus. For example, the CPU 1312 counts the number of image formed sheets as the operating state, reads out correction profile data corresponding to the count value from the NVRAM 1314, and sets a correction profile data to be used in image forming. That is, correction profile data corresponding to each of a plurality of count values is assumed to be prestored in the NVRAM 1314. Alternatively, the control unit 1313, by multiplying the underlying correction profile data by a coefficient corresponding to the count value, may calculate correction profile data, which corresponds to that count value.

In the present embodiment, an image-forming apparatus that uses a one-component developing-material was described. However, the present invention can, needless to say, also be applied to an image-forming apparatus that uses a two-component developing-material. The effect of the present invention is, however, probably more readily obtained with a one-component developing-material, since a more non-uniform charged electric charge distribution of toner is likely to occur. Moreover, with an image-forming apparatus that uses a two-component developing-material, negatively charged electric charge in the toner layer on the developing roller may have a distribution in which the amount of charge is small on the upstream side and increases on the downstream side in the carrying direction of the toner carrying screw, this being the opposite case to an image-forming apparatus that uses a one-component developing-material. Also when the configuration of the developing container 141 shown in FIG. 3 is reversed left to right, the distribution of negatively charged electric charge will be opposite to the distribution shown in FIG. 4. In these cases, the gradient of the amount of exposure light distribution need only be reversed to that of the foregoing embodiment. That is, correction profile data need merely be created and used so that photosensitive drum surface light quantity on the right side of the image is 10% lower than the left side of the image.

While a full-color image-forming apparatus was described in the present embodiment, the present invention can also be applied in relation to a mono-color image-forming apparatus. In this case, the effect of the present invention is similarly obtained. With a full-color image-forming apparatus, however, image defects such as density nonuniformity are readily noticeable in comparison with a mono-color image-forming apparatus, since different color images are superimposed to form a multicolor image. Consequently, demand for the present invention is likely to be greater with full-color image-forming apparatuses.

In the present embodiment, the OFS system was employed in the laser exposure device. However, the present invention can be applied in relation to an image-forming apparatus having a laser exposure device that employs the UFS system. In this case, the effect of the present invention can be similarly obtained by executing laser drive control in accordance with the optical characteristics of a UFS laser exposure device, and providing the longitudinal amount of light on the photosensitive drum surface with a prescribed distribution.

While a semiconductor laser was described as an exemplary light source in the present embodiment, the present invention can also be applied in relation to other light sources such as LED.

In the present embodiment, the correction profile data was described as being created by the image-forming apparatus. However, the correction profile data may be created by an external apparatus provided with a CPU and sensors equivalent to the CPU 1312 and the sensors 1701 to 1705. Also, by using removable sensors for the sensors 1701 to 1705, the sensors 1701 to 1705 may be just connected to the CPU 1312 for use at the factory before shipping. This will likely contribute to cost reduction since the sensors 1701 to 1705 do not need to be provided in each image-forming apparatus.

It is noted here that the various modifications mentioned above apply similarly to the following embodiments.

Embodiment 2

In the present embodiment, a correction unit that corrects fluctuation in image density caused by a difference in the charging characteristics of the developing-material is realized by manipulating the exposure sensitivity of the image carrier. That is, an image carrier is employed that is manufactured so that exposure sensitivity gradually decreases from the end of the image carrier corresponding to the upstream side in the carrying direction of the developing-material to the other end of the image carrier corresponding to the downstream side in the carrying direction of the developing-material. Consequently, controlling amount of laser exposure light such as in Embodiment 1 is not necessarily required.

Figure 19:
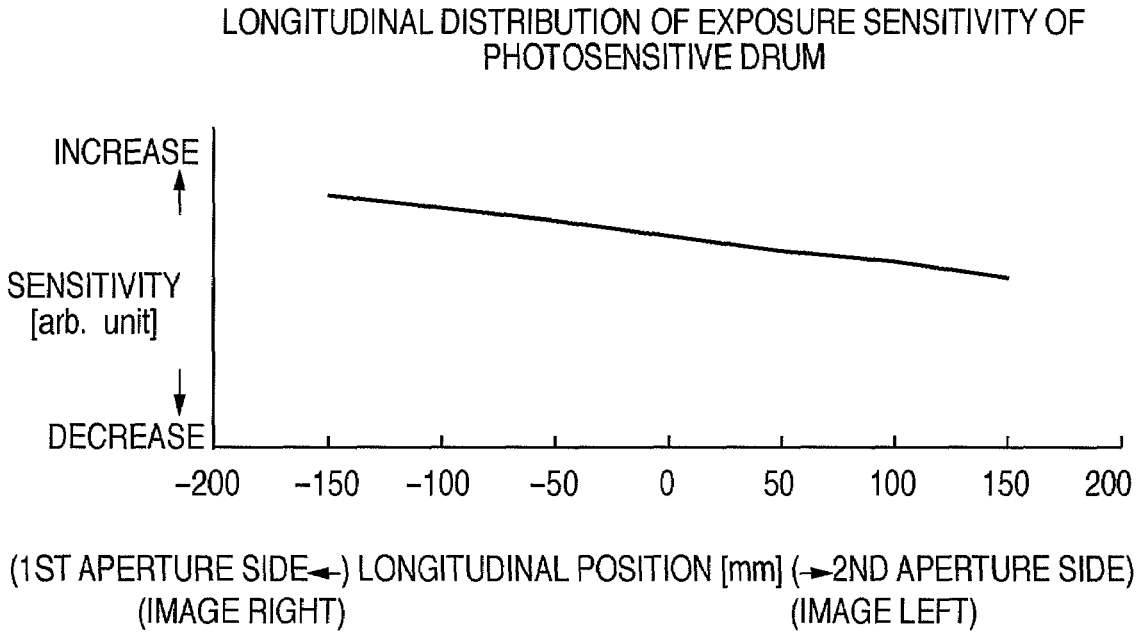
FIG. 19 shows an exemplary exposure sensitivity of a photosensitive drum according to a preferred embodiment.

FIG. 19 shows an exemplary exposure sensitivity of the photosensitive drum according to the present embodiment. The horizontal axis shows the longitudinal position on the photosensitive drum. The vertical axis shows the exposure sensitivity on the photosensitive drum surface in a corresponding longitudinal position.

According to FIG. 19, sensitivity on the photosensitive drum is high at the end corresponding to the first aperture side of the developing roller and low at the end corresponding to the second aperture side. The photosensitive drum 11 has a sensitivity gradient such as this. To achieve such a sensitivity gradient, the photosensitive drum 11 needs to be manufactured with the material characteristics, film thickness and the like of the photoconductive layer adjusted in the longitudinal direction.

The longitudinal distribution of amount of laser exposure light in Embodiment 2 can be similar to that shown in FIG. 5. However, since the photosensitive drum 11 has a longitudinal distribution of exposure sensitivity such as shown in FIG. 19, the exposure potential that is formed alters even if the same light quantity exposure is performed at each longitudinal position. In other words, a low (absolute value of the) exposure potential is obtained on the first aperture side where exposure sensitivity is high, and a relatively high (absolute value of the) exposure potential is obtained on the second aperture side where exposure sensitivity is low. For example, the longitudinal distribution of exposure potential when the photosensitive drum is exposed with 70% density will be similar to FIG. 10. Accordingly, image density on the transfer material will have a uniform longitudinal distribution, similarly to FIG. 11 in Embodiment 1 (Study 2).

According to the present embodiment as described above, the occurrence of image defects such as density nonuniformity is suppressed and a favorable image is obtained, by providing the photosensitive drum with an exposure sensitivity that corrects fluctuation in image density caused by a difference in the charging characteristics of the developing-material.

The configuration of Embodiment 2 would be particularly effective in an image-forming apparatus in which laser exposure device control such as discussed in Embodiment 1 cannot be implemented due to manufacturing cost reduction or the like. This is because modifying only the photosensitive drum does not incur a significant rise in manufacturing costs.

Embodiment 3

The foregoing embodiment was described in terms of the CPU 1312 counting the number of image formed sheets as the operating state, for example, and reading out correction profile data corresponding to the count value from the NVRAM 1314. In the present embodiment, this will be described in greater detail.

Hereinafter, a configuration will be described in which a plurality of correction profiles for altering the amount of light of the laser emitting unit from one end of the photosensitive drum to the other are stored in the NVRAM 1314, the gradient of density alteration caused by continuous alteration in the charging characteristics of the toner used is detected by forming and detecting toner images (patches) on the left and right, and the appropriate correction profile is read out and set based on the detection results.

Description of Density Sensors

Figure 20:
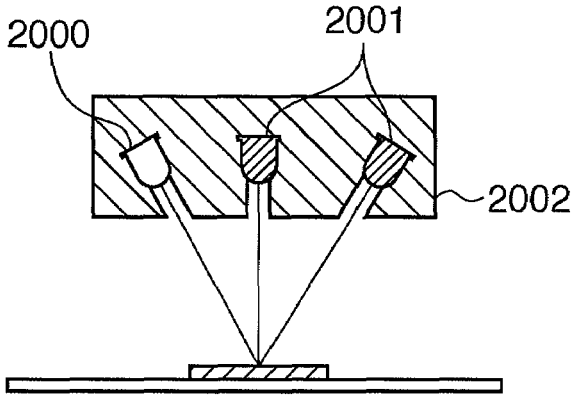
FIG. 20 shows an exemplary density sensor.

FIG. 20 shows the configuration of a density sensor serving as an image density detecting unit. This density sensor is, for example, provided in a position opposing the drive roller 17 in FIG. 1. In the present embodiment, a plurality of density sensors are provided in the longitudinal direction of the drive roller 17, in order to detect density nonuniformity in the longitudinal direction of the photosensitive drum. The more density sensors there are arranged in the longitudinal direction, the greater the precision with which density nonuniformity in the longitudinal direction can be detected.

The density sensors are constituted by a light-emitting element such as an LED 2000, a light-receiving element such as a photodiode 2001 or a CdS, and a holder 2002.

Light from the light-emitting element is irradiated onto toner images (hereinafter, called patches) for image density control formed on the intermediate transfer belt 1, and the density of the patches is measured by the light-receiving element receiving specular reflected light and diffuse reflected light therefrom.

Installation and Density Detection of Density Sensors

Figure 21:
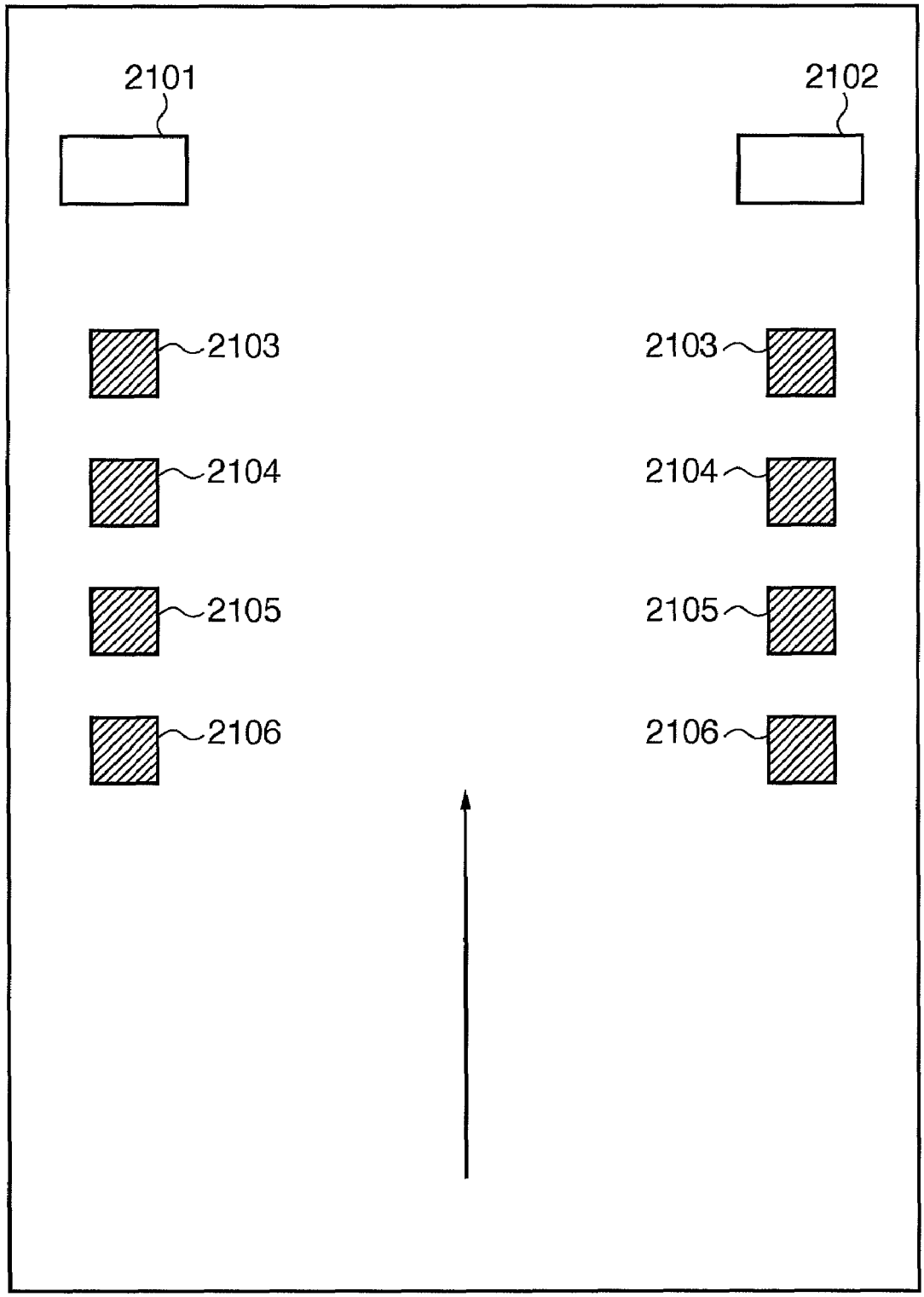
FIG. 21 shows an example of toner images (patches) when formed.

FIG. 21 shows the arrangement and density detection of density sensors relative to the intermediate transfer belt 1. In FIG. 21, two density sensors are installed, 2101 being installed on the first aperture side and 2102 being installed on the second aperture side.

Toner images (patches) for image density difference detection having the same density (e.g., 70% halftone) on the first aperture side and the second aperture side are formed on the intermediate transfer belt 1. A toner image (patch) is formed for each color.

The intermediate transfer belt 1 rotates in the direction of the arrow in FIG. 21, and the density of the toner images is detected using the density sensors.

While an example is shown in which toner image density is detected with only 70% halftones, for example, at which the density difference between left and right images is pronounced, toner images of a number of densities may be formed and detected.

Image density nonuniformity detection control in the present embodiment desirably is performed after performing gradation control to adjust the gradation characteristics of the image to prescribed characteristics.

Formation and Detection of Patch Images

Figure 22:
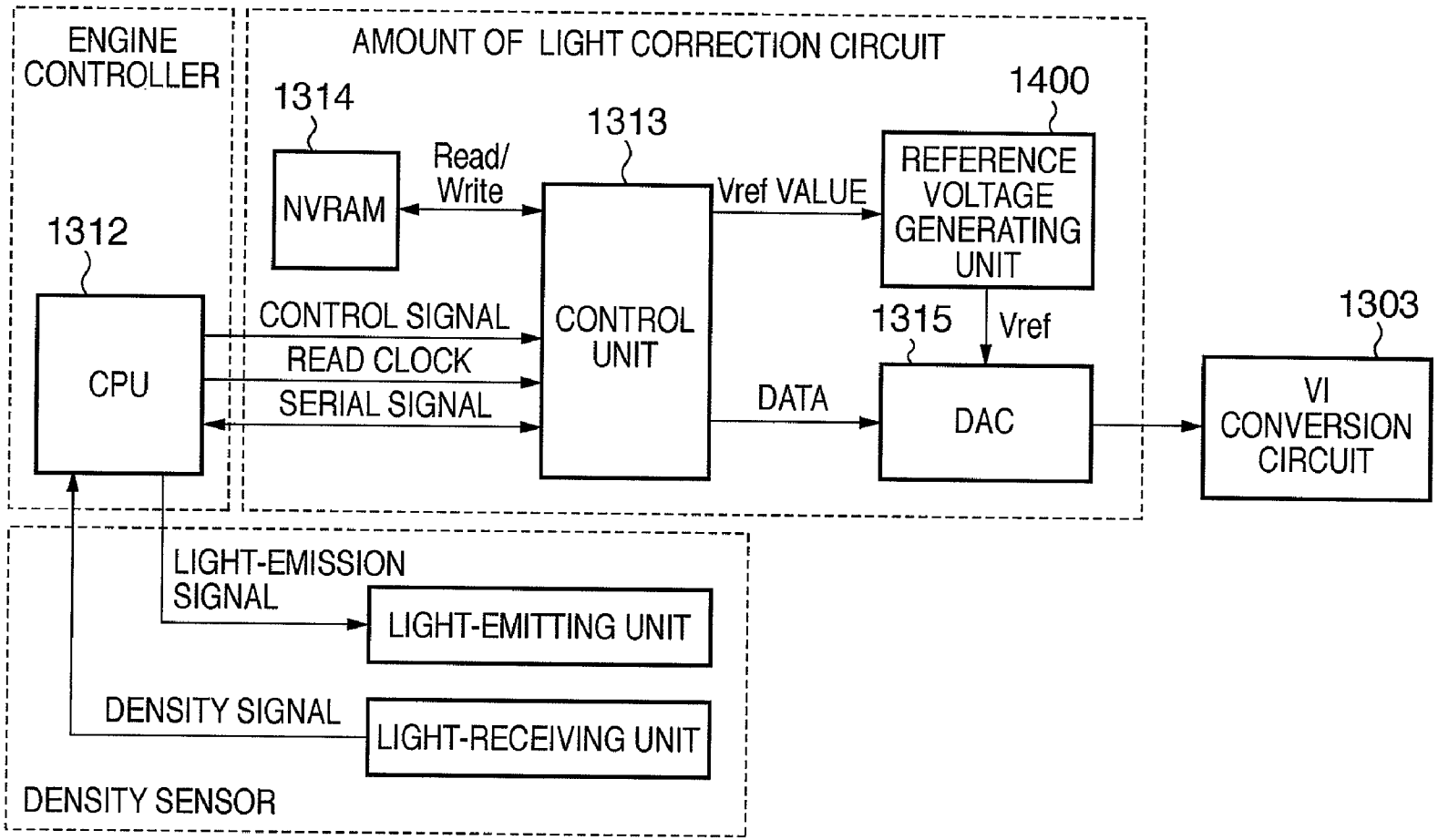
FIG. 22 shows an exemplary block diagram of an amount of light correction circuit.

FIG. 22 shows an exemplary laser drive circuit, an exemplary engine controller and an exemplary density sensor involved in amount of light correction control according to the present embodiment. The difference with FIG. 14 is that the density sensors are connected to the CPU 1312, and the CPU performs various calculations after importing the detection results of the density sensors.

The control for detecting the density difference between the left and right images is, specifically, performed as follows. Firstly, the CPU starts the image density difference detection control, once a CPU inside the control unit has detected an appropriate timing such as an instruction from a host computer or a user, or the cumulative number of image formed sheets of the developing apparatus. The flowcharts and the like in FIG. 18 described above and FIGS. 23A-1, 23A-2, 23B, 24 and 25 described below are executed in response to the start of the image density difference detection control by the CPU.

The CPU reads out the developing biases of the colors for use in the image density difference detection control from a ROM in the control unit. Subsequently, the CPU starts an initialization operation of the image-forming apparatus, and respectively charges the photosensitive drums 1Y to 1Bk with a prescribed charging bias.

Next, the CPU sends the image data of the patches for image density difference detection generated by a test pattern generating unit to the exposure apparatus, and forms a latent image of the toner images (patches) on the photosensitive drum along the rotation direction. The toner images (patches) formed on the photosensitive drums are transferred to the transfer belt by applying a voltage between the photosensitive drum and the transfer roller.

Magenta (M) patches 2104, cyan (C) patches 2105 and black (Bk) patches 2106 are similarly formed after yellow (Y) patches 2103, and the patches are then formed on the transfer belt. The CPU sends a light-emission signal to the light-emitting units of the density sensors to cause to the LEDs to emit light.

Next, these patches Y, M, C and Bk are respectively measured by the light-receiving units of the density sensors, and the CPU detects the results as density signals. The CPU writes the detected density measurement values $D_R$Y, $D_R$M, $D_R$C and $D_R$Bk of the first aperture side and the detected density measurement values $D_L$Y, $D_L$M, $D_L$C and $D_L$Bk of the second aperture side to the RAM inside the control unit.

Meanwhile, the patches formed on the transfer belt are cleaned by a transfer belt cleaning unit.

Once the patches have been measured, the CPU compares the densities of the patches for each color saved in the RAM, and calculates the density difference between the left and right images.

Correction Profile Creation Procedure

The procedure for creating correction profile data for controlling the laser drive current will be described next.

Firstly, the amount of light of the photosensitive drum surface along the scanning direction is measured in several places by the laser exposure device 13 in advance at the factory or the like, with amount of light correction non-operational. The measured amount of light is called photosensitive drum surface light quantity.

Here, the photosensitive drum surface light quantity is the amount of laser light of the beam irradiated from the laser when actually exposed on the photosensitive drum via an optical system such as an fθ lens or a reflex mirror.

Next, correction profile data such that photosensitive drum surface light quantity is uniform throughout is normally created.

The correction profile data at which the photosensitive drum surface light quantity is uniform is stored in the NVRAM of the amount of light correction circuit, with the correction profile data being $P_0$, and the reference voltage $V_{ref}$ value at this time being $V_{ref0}$.

Next, correction profile data corrected so that the data values rise linearly by 10% from the right edge of the image to the left edge is created.

This correction profile data is $P_{+10}$, which is stored, together with the reference voltage $V_{ref}$ value at this time, $V_{ref+10}$, in the NVRAM of the amount of light correction circuit as the profile to be employed in the case where the density differences $D_d$Y, $D_d$M, $D_d$C and $D_d$Bk between the left and right images are greater than +7.5%.

Similarly, the correction profile data corrected so that the data values rise linearly by 5% from the right edge of the image to the right edge will be $P_{+5}$, and the reference voltage $V_{ref}$ value at this time will be $V_{ref+5}$. These are set as the profile to be employed in the case where the density differences $D_d$Y, $D_d$M, $D_d$C and $D_d$Bk between the left and right images are greater than or equal to +2.5% and less than or equal to +7.5%. Again, the correction profile data corrected so as to decrease by 10% will be $P_{-10}$, and the reference voltage $V_{ref}$ value at this time will be $V_{ref-10}$, which are set as the profile to be employed in the case where the density differences $D_dY$, $D_dM$, $D_dC$ and $D_dBk$ between the left and right images are less than −7.5%. Again, the correction profile data corrected so as to decrease by 5% will be $P_{-5}$, and the reference voltage $V_{ref}$ value at this time will be $V_{ref-5}$, which are set as the profile to be employed in the case where the density differences $D_dY$, $D_dM$, $D_dC$ and $D_dBk$ between the left and right images are greater than or equal to −7.5% and less than or equal to −2.5%. The individual profiles are stored in the NVRAM of the amount of light correction circuit.

FIG. 23B shows exemplary RAM data in the NVRAM of the amount of light correction circuit. The criteria for selecting correction data, the respective correction profile data obtained by dividing the beam scanning length into 22 intervals, and the reference voltages $V_{ref}$ corresponding to the respective correction profile data are stored as data. Note the beam scanning length is divided into 22 intervals by way of example, and may be divided into smaller intervals.

Correction Profile Selection Method

Figures 1, 23A:
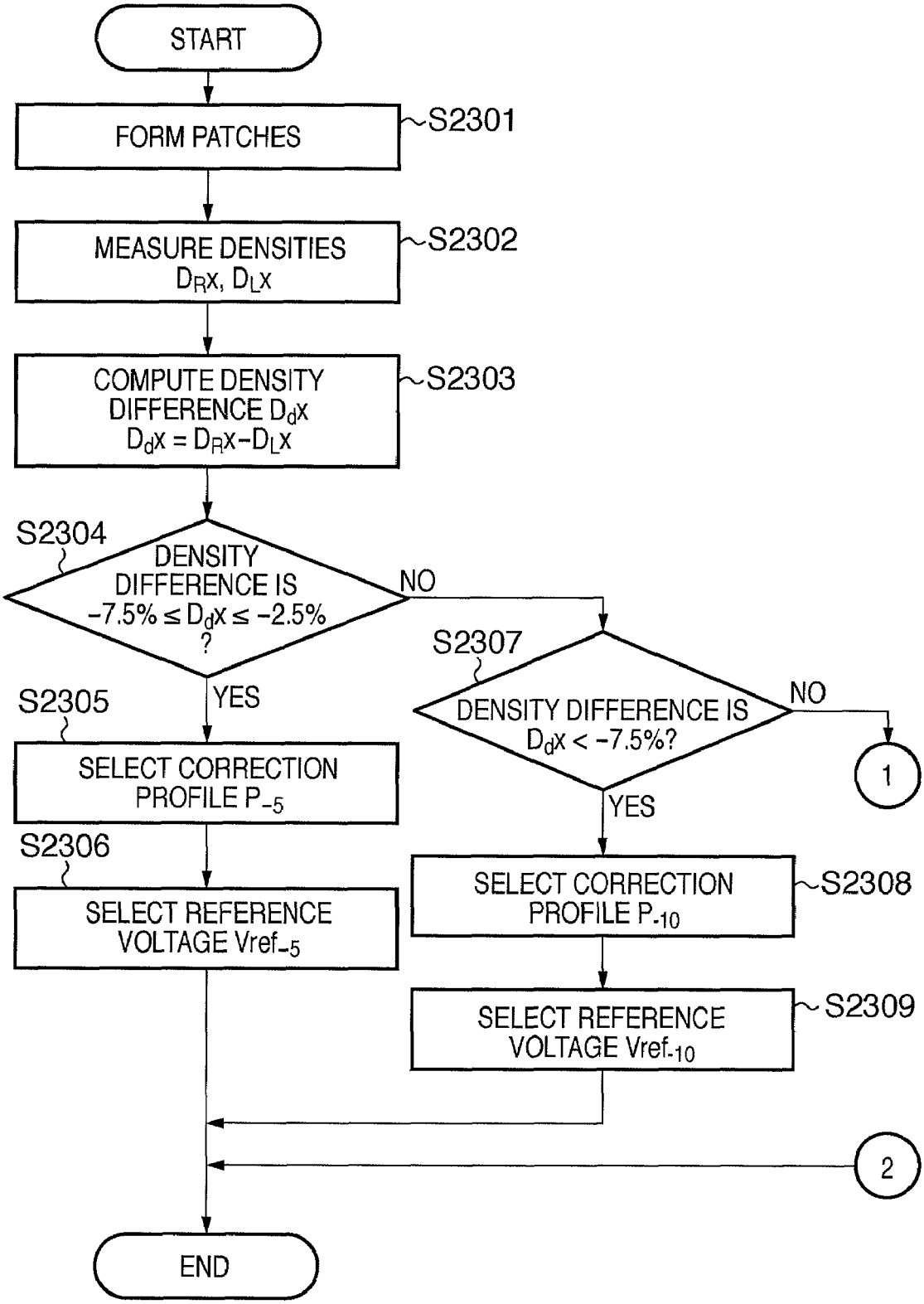
Figures 2, 23A:
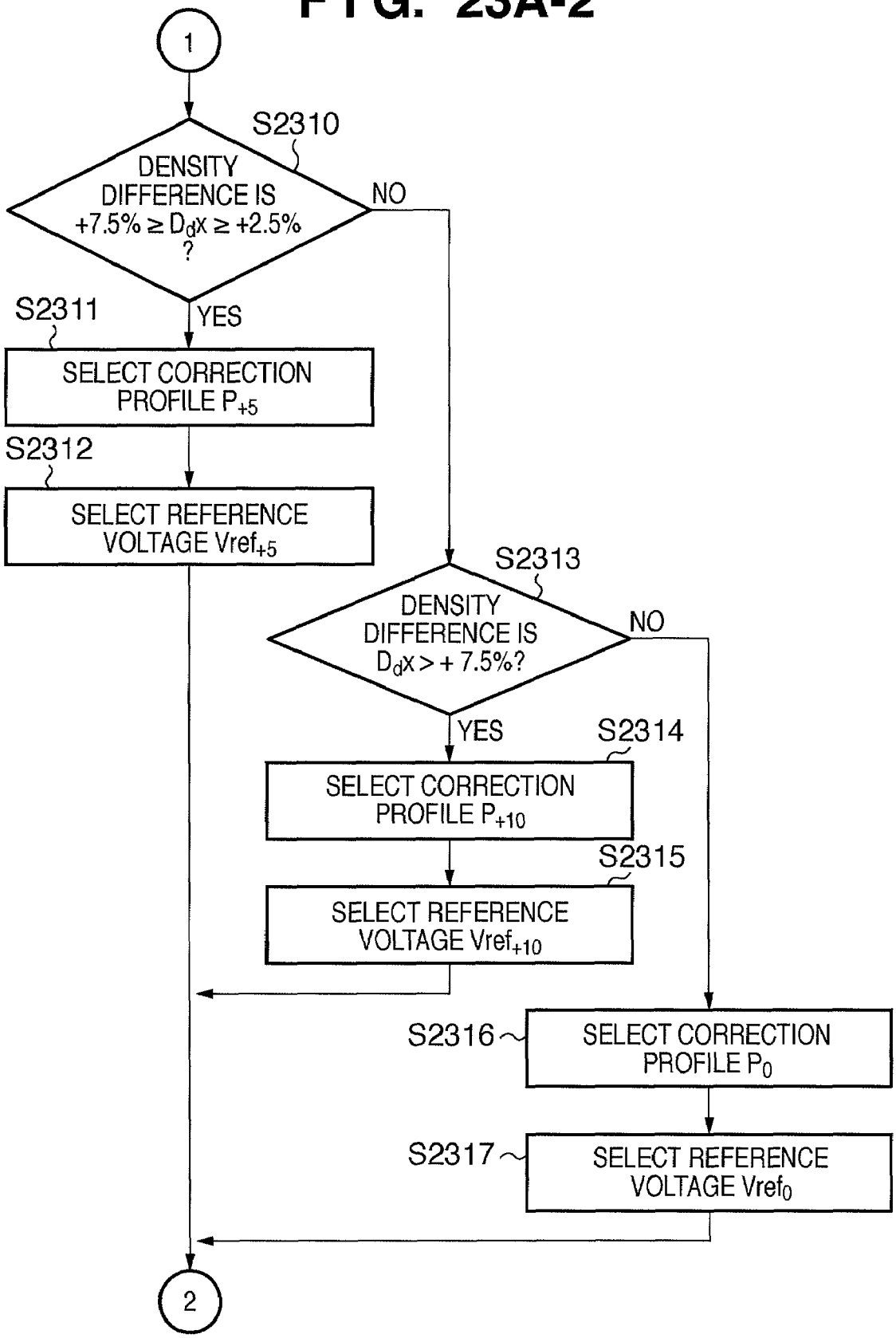

Here, the flowcharts of FIGS. 23A-1 and 23A-2 will be used to describe an exemplary method in which the amount of emitted light of the laser is controlled after selecting the optimum correction profile from the prestored correction profiles, based on the density differences between the left and right images detected by the density sensors.

Note that as described above the flowcharts of FIGS. 23A-1, 23A-2 and 23B are executed at a timing such as an instruction from a host computer or a user, or the cumulative number of image formed sheets of the developing apparatus.

At step S2301, the CPU sends the image data of patches for image density difference detection generated by the test pattern generating unit to the exposure apparatus. Toner images (patches) Y, M, C and Bk for image density difference detection are formed on the photosensitive drums in one place each on the first aperture side and the second aperture side where the density sensors are installed.

Note that when toner images are formed at step S2301, exposure is performed based on a correction profile that cancels the light amount distribution on the photosensitive drum surface measured at step S1803. The correction profile used at this time is equivalent to a quartic approximation determined in the case where the values derived from the linear equation, Equation (2), at step S1804 are not added. The $V_{ref}$ value in the case where the maximum voltage value out of the sensor output values is FFh can be determined by executing S1807 to S1809 of FIG. 18 with respect to the quartic approximation determined in the case where the values derived from the linear equation, Equation (2), are not added.

Returning to the description of FIG. 23A-1, the CPU, at step S2302, causes the light-emitting units of the density sensors to emit light, the toner images (patches) Y, M, C and Bk for image density difference detection are respectively measured by the light-receiving units of the density sensors, and the CPU detects the results as density signals. The CPU writes the detected density measurement values $D_RY$, $D_RM$, $D_RC$ and $D_RBk$ of the first aperture side and the detected density measurement values $D_LY$, $D_LM$, $D_LC$ and $D_LBk$ of the second aperture side to the RAM inside the control unit.

Once the patch densities have been measured, the CPU, at step S2303, compares the densities of the patches using the density measurement values $D_RY$, $D_RM$, $D_RC$ and $D_RBk$ of the first aperture side and the density measurement values $D_LY$, $D_LM$, $D_LC$ and $D_LBk$ of the second aperture side stored in the RAM. The density differences $D_dY$, $D_dM$, $D_dC$ and $D_dBk$ between the left and right images are then respectively calculated as $D_dY=D_RY-D_LY$, $D_dM=D_RM-D_LM$, $D_dC=D_RC-D_LC$, and $D_dBk=D_RBk-D_LBk$.

Then, at steps S2304 to S2312, the optimum amount of light correction profile data is set for use in image-forming after collating the results derived at step S2303 with the table shown in FIG. 23B. In FIGS. 23A-1 and 23A-2, correction profile data for canceling the fluctuation in image density (illustrated in FIG. 7) caused by continuous alteration in the charging characteristics of the toner used is stored in correspondence with fluctuations due to a plurality of image densities. The steps will be described in detail below.

At step S2304, the CPU judges whether the density differences $D_dY$, $D_dM$, $D_dC$ and $D_dBk$ between the left and right images calculated at step S2303 are greater than or equal to −7.5% and less than or equal to −2.5%. The processing proceeds to step S2305 when judged in the affirmative, and to step S2307 when judged in the negative.

In the case where it is judged that the density differences $D_dY$, $D_dM$, $D_dC$ and $D_dBk$ between the left and right images are greater than or equal to −7.5% and less than or equal to −2.5%, the CPU, at step S2305, selects the correction profile data $P_{-5}$ corrected so that the amount of exposure light of the left edge of the image is 5% lower than the right edge of the image. Next, at step S2306, the CPU selects and sets the reference voltage $V_{ref-5}$.

At step S2307, the CPU judges whether the density differences $D_dY$, $D_dM$, $D_dC$ and $D_dBk$ between the left and right images calculated at step S2303 are less than −7.5%. The processing proceeds to step S2308 when judged in the affirmative, and to step S2310 when judged in the negative.

In the case where the density differences $D_dY$, $D_dM$, $D_dC$ and $D_dBk$ between the left and right images are less than −7.5%, the CPU, at step S2308, selects and sets the correction profile data $P_{-10}$ corrected so that the amount of exposure light of the left edge of the image is 10% lower than the right edge of the image. Next, at step S2309, the CPU selects and sets the reference voltage $V_{ref-10}$.

At step S2310, the CPU judges whether the density differences $D_dY$, $D_dM$, $D_dC$ and $D_dBk$ between the left and right images calculated at step S2303 are greater than or equal to +2.5% and less than or equal to +7.5%. The processing proceeds to step S2311 when judged in the affirmative, and to step S2313 when judged in the negative.

In the case where the density differences $D_dY$, $D_dM$, $D_dC$ and $D_dBk$ between the left and right images are greater than or equal to +2.5% and less than or equal to +7.5%, the CPU, at step S2311, selects and sets the correction profile data $P_{+5}$ corrected so that the amount of exposure light of the left edge of the image is 5% higher than the right edge of the image. Next, at step S2312, the CPU selects and sets the reference voltage $V_{ref+5}$.

At step S2313, the CPU judges whether the density differences $D_dY$, $D_dM$, $D_dC$ and $D_dBk$ between the left and right images calculated at step S2303 are greater than +7.5%. The processing proceeds to step S2314 when judged in the affirmative, and to step S2316 when judged in the negative, where the CPU selects and sets the correction profile data $P_0$ at which the photosensitive drum surface light quantity is uniform throughout. Then, at step S2317, the CPU selects and set the reference voltage $V_{ref0}$.

In the case where the density differences $D_dY$, $D_dM$, $D_dC$ and $D_dBk$ between the left and right images are greater than +7.5%, the CPU, at step S2314, selects and sets the correction profile data $P_{+10}$ corrected so that the amount of exposure light of the left edge of the image is 10% higher than the right edge of the image. Next, at step S2315, the CPU selects the reference voltage $V_{ref+10}$.

According to the present embodiment as described above, fluctuation in image density caused by continuous alteration in the charging characteristics of the toner used from one end of the image carrier to the other can be dynamically addressed with a simple mechanism.

More specifically, by correcting the fluctuation in image density caused by a difference in the charging characteristics of the developing-material, the occurrence of image defects such as density nonuniformity is suppressed and a favorable image is obtained, even in a state where newly replenished developing-material is mixed with deteriorated developing-material.

Further, by detecting the density difference between left and right images using density sensors at any time, and selecting the optimum correction profile for resolving the density difference between left and right based on the detection results, the effect of fluctuation in the charging characteristics of the developing-material over time can be reduced. Consequently, the occurrence of image defects such as density nonuniformity is suppressed more than Embodiment 1, allowing a favorable image to be obtained.

Embodiment 4

The foregoing Embodiment 3 was described in terms of a correction profile that corresponds to the situation in each case being selected from a plurality of correction profiles stored in the NVRAM 1314 beforehand.

In contrast, in the present embodiment, the case where a correction profile and a $V_{ref}$ value are calculated and determined on the spot according to the situation in each case will be described.

Correction Profile Creation Procedure

Figure 24:
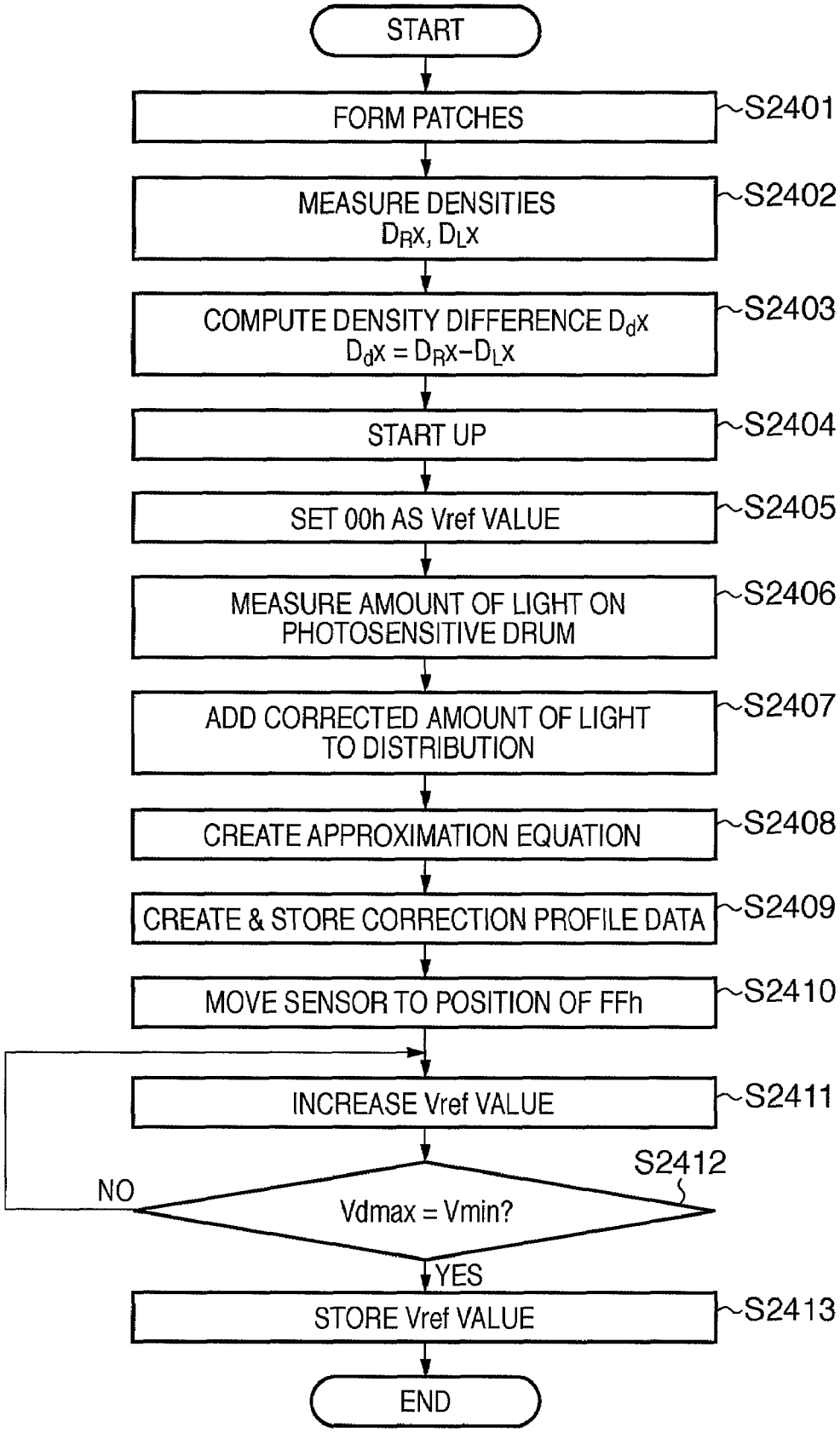
FIG. 24 is a flowchart showing an exemplary method of setting correction profile data and a DAC reference voltage $V_{ref}$ value.

FIG. 24 is a flowchart for determining a correction profile and a $V_{ref}$ value for correcting fluctuation in image density. Fluctuation in image density here is caused by the nonuniformity of an upwardly convex light amount distribution in which amount of light increases in a medial portion between both edge portions of the photosensitive drum, and by toner charging characteristics that alter along the longitudinal direction of the developing roller.

More specifically, FIG. 24 is a flowchart showing an exemplary method of setting correction profile data and the DAC reference voltage value $V_{ref}$, and an exemplary calculation of correction profile data according to the present embodiment.

Note that the timing at which the flowchart of FIG. 24 is executed is similar to the execution timing of the flowcharts in FIGS. 23A-1, 23A-2 and 23B.

In the present flowchart, the setting of the $V_{ref}$ value and the calculation of correction profile data will be described using the yellow (Y) station as an example.

(Step S2401)

At step S2401, the CPU sends the image data of patches for image density difference detection generated by the test pattern generating unit to the laser exposure device 13. Toner images (patches) Y, M, C and Bk for image density difference detection are formed on the photosensitive drums in one place each on the first aperture side and the second aperture side where the density sensors are installed. The formation of the patches is as shown in FIG. 21.

(Step S2402)

At step S2402, the CPU causes the light-emitting units of the density sensors to emit light, the toner images (patches) Y, M, C and Bk for image density difference detection are respectively measured by the light-receiving units of the density sensors, and the CPU detects the results as density signals. The CPU writes the detected density measurement values $D_RY$, $D_RM$, $D_RC$ and $D_RBk$ of the first aperture side and the detected density measurement values $D_LY$, $D_LM$, $D_LC$ and $D_LBk$ of the second aperture side to the RAM inside the control unit.

(Step S2403)

At step S2403, the CPU compares the densities of the patches using the density measurement values $D_RY$, $D_RM$, $D_RC$ and $D_RBk$ of the first aperture side and the density measurement values $D_LY$, $D_LM$, $D_LC$ and $D_LBk$ of the second aperture side stored in the RAM. More specifically, the density differences $D_dY$, $D_dM$, $D_dC$ and $D_dBk$ between the left and right images are respectively calculated as $D_dY=D_RY-D_LY$, $D_dM=D_RM-D_LM$, $D_dC=D_RC-D_LC$, and $D_dBk=D_RBk-D_LBk$.

Hereinafter, because steps S2404 to S2406 are basically similar to FIG. 18 described above, a detailed description thereof will be omitted here.

(Step S2407)

At step S2407, the CPU 1312 increases or decreases (reflects) the sensor output voltage values. More specifically, the CPU 1312 decreases the sensor output voltage value at −150 mm on the right edge of the image by $(D_dY/2)\%$, and increases the sensor output voltage value at +150 mm on the left edge of the image by $(D_dY/2)\%$, based on the judgment result at step S2403. The CPU 1312 determines a linear equation, Equation (2), such that the sensor output voltage value is neither increased nor decreased at 0 mm in the center, is decreased by $(D_dY/2)\%$ at −150 mm, and is increased by $(D_dY/2)\%$ at +150 mm.

$$mx+n \tag{2}$$

Here, the variable x is a beam scanning position obtained when the beam scanning length is divided by a prescribed value.

The CPU 1312 then adds the values derived from the linear equation determined by Equation (2) to the values actually measured for the five places in the longitudinal light amount distribution on the photosensitive drum surface, and obtains measurement results after correction. It is thus possible in the processing from step S2408 onwards to determine a correction profile for correcting the upwardly convex light amount distribution obtained after reflecting the density detection results (toner charging characteristics) in the nonuniformity of the upwardly convex light amount distribution in which toner charging characteristics have not been taken into account such as shown in FIG. 17.

In steps S2408 to S2413, similar processing to steps S1805 to S1809 in FIG. 18 is performed. Here, a detailed description thereof will be omitted.

The foregoing flowchart results in amount of light after amount of light correction such that the amount of light of the right edge of the image is increased by $(D_dY/2)\%$ and the amount of light of the left edge of the image is decreased by $(D_dY/2)\%$ relative to the amount of light at the image center. Correction profile data can thus be corrected so that the data values rise linearly by $D_dY$ % from the right edge of the image to the left edge. Not only the upwardly convex light amount distribution on the photosensitive drum surface shown in FIG. 17, but also environmental change and aging of negatively charged electric charge in the longitudinal direction of the developing roller such as illustrated in FIG. 4 can be flexibly addressed.

Note that while the present flowchart was described using the yellow station as an example, processing is similarly executed in relation to the other stations.

Embodiment 5

In the foregoing Embodiment 4, a configuration was described in which a correction profile was calculated using the sensors 1701 to 1705 shown in FIG. 17. In contrast, in the present embodiment, a configuration will be described in which the sensors 1701 to 1705 are connected to the CPU 1312 and used only once at the factory before shipping or the like. A correction profile is then calculated by the user's image-forming apparatus itself, without using the sensors 1701 to 1705 for measuring amount of light on the photosensitive drum surface.

This would likely contribute to cost reduction, since the sensors 1701 to 1705 no longer need to be provided in each image-forming apparatus.

Firstly, the premises will be described. In the present embodiment, the amount of light of five places, namely, 0 mm, ±100 mm and ±150 mm, with the center of the image width of the photosensitive drum surface being 0 mm, are measured at the factory, for example, using the sensors 1701 to 1705, with amount of light correction in a non-operational state, as illustrated in FIG. 17. The resultant sensor output voltage values are stored in the NVRAM 1314 of the amount of light correction circuit 1302.

Also, based on the measurement results obtained for the five places, a correction profile for suppressing the nonuniformity of light amount distribution characteristic of OFS and a DAC reference voltage $V_{ref}$ value are measured in advance at the factory before shipping, and stored in the NVRAM 1314 of the amount of light correction circuit 1302. Fluctuation in image density caused by a difference in the charging characteristics of the developing-material is not taken into account in the correction profile corresponding to the $V_{ref}$ value stored in advance.

Correction Profile Data Creation Procedure of User's Image-Forming Apparatus

Figure 25:
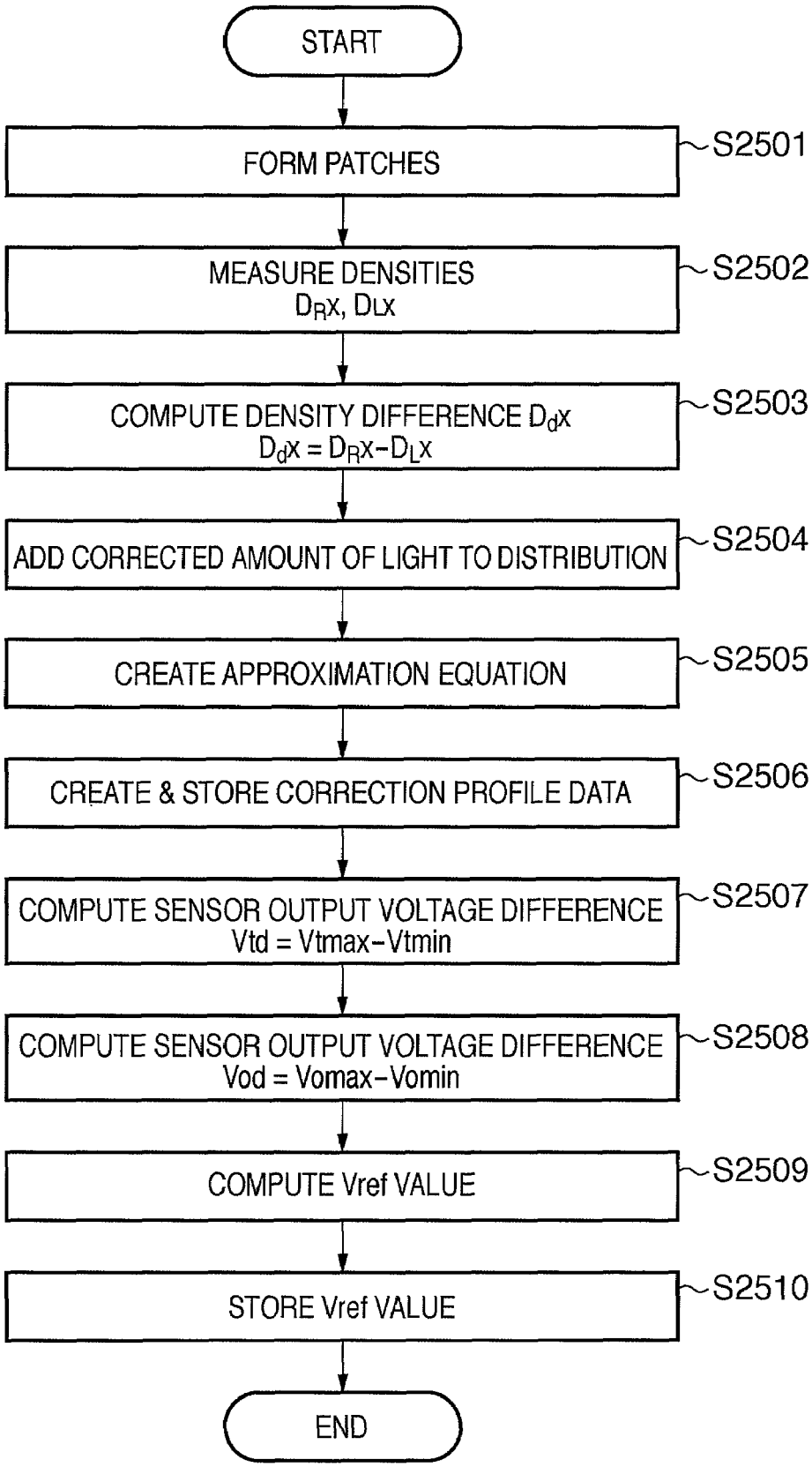
FIG. 25 is a flowchart showing an exemplary method of setting correction profile data and a DAC reference voltage $V_{ref}$ value.

FIG. 25 is a flowchart for determining a correction profile and a $V_{ref}$ value for correcting fluctuation in image density. Fluctuation in image density here is caused by the nonuniformity of an upwardly convex light amount distribution in which amount of light increases in a medial portion between both edge portions of the photosensitive drum, and by toner charging characteristics that alter along the longitudinal direction of the developing roller.

More specifically, FIG. 25 shows an even easier way of setting correction profile data and the DAC reference voltage value $V_{ref}$, and calculating correction profile data according to the present embodiment, compared with the case of FIG. 24.

Note that the timing at which the flowchart of FIG. 25 is executed is similar to the execution timing of the flowcharts in FIGS. 23A-1, 23A-2, 23B and 24.

Note that in the present flowchart, the setting of the $V_{ref}$ value and the calculation of correction profile data will be described using the yellow (Y) station as an example.

Firstly, because the processing of steps S2501 to S2503 are similar to steps S2401 to S2403 described previously, a detailed description thereof will be omitted.

(Step S2504)

At step S2504, the CPU 1312 reads from the NVRAM 1314 the sensor output voltage values of the five places 0 mm, ±100 mm and ±150 mm measured with amount of light correction in a non-operational state and prestored at the factory. The CPU 1312 then increases or decreases (reflects) the sensor output voltage values of the five places 0 mm, ±100 mm and ±150 mm measured with amount of light correction in a non-operational state and prestored at the factory, based on the result of the density difference $D_dY$ between left and right images obtained at S2503.

More specifically, the CPU 1312 decreases the sensor output voltage value at −150 mm on the right edge of the image by $(D_dY/2)$%, and increases the sensor output voltage value at +150 mm on the left edge of the image by $(D_dY/2)$%. The CPU 1312 then determines a linear equation, Equation (2), such that the sensor output voltage value is neither increased nor decreased at 0 mm in the center, is decreased by $(D_dY/2)$% at −150 mm, and is increased by $(D_dY/2)$% at +150 mm.

$$mx+n \tag{2}$$

Here, the variable x is a beam scanning position obtained when the beam scanning length is divided by a prescribed value.

Further, the CPU 1312 adds (reflects) the values derived from the linear equation determined by Equation (2) to the values actually measured for the five places in the longitudinal light amount distribution on the photosensitive drum surface, and obtains measurement results after correction. It is thus possible in the processing from step S2505 onwards to determine a correction profile for correcting the upwardly convex light amount distribution obtained after reflecting the density detection results in the nonuniformity of the upwardly convex light amount distribution in which toner charging characteristics have not been taken into account such as shown in FIG. 17.

(Step S2505)

Then, at step S2505, the alteration in the sensor output voltage values at beam scanning positions obtained when the beam scanning length is divided by a prescribed value is approximated with a quartic equation, Equation (3), based on the measurement results after correction.

$$ax^4+bx^3+cx^2+dx+e \tag{3}$$

Further, the quartic approximation derived by Equation (3) is used to determine the sensor output voltage values at the beam scanning positions.

(Step S2506)

The processing at step S2506 is similar to the foregoing step S1806, thus a detailed description thereof will be omitted.

(Step S2507)

At step S2507, the CPU 1312 calculates Vtd=Vtmax−Vtmin, where Vtmax and Vtmin are respectively the maximum and minimum voltage values out of the sensor output values at the scanning positions calculated at step S2506.

(Step S2508)

At step S2508, the CPU 1312 reads the sensor output voltage values of the five places 0 mm, ±100 mm and ±150 mm measured with amount of light correction in a non-operational state and prestored in the NVRAM 1314. The CPU 1312 determines the sensor output values of the scanning positions using processing similar to steps S1804 to S1806, based on the read sensor output voltage values. The CPU 1312 calculates Vod=Vomax−Vomin, where Vomax and Vomin are respectively the maximum and minimum voltage values out of the calculated sensor output values in the scanning positions.

Figure 26:
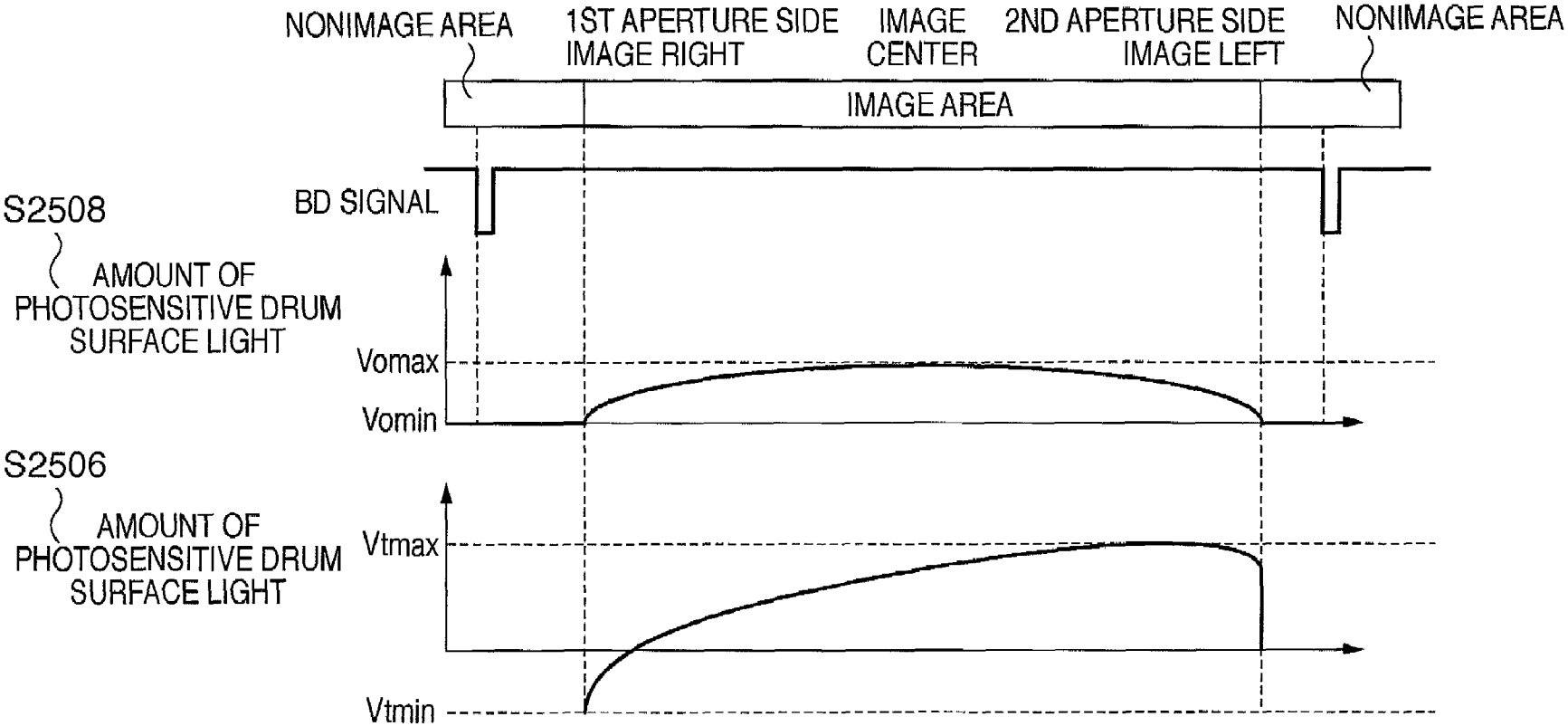
FIG. 26 illustrates a correction profile calculation method.

Here, the sensor output values of the scanning positions calculated at step S2506 of the present flowchart and the sensor output values of the scanning positions determined at step S2508 are shown in FIG. 26. The correction profile data of the Vtmax scanning position will be FFh, and the correction profile data of the Vtmin scanning position will be 00h.

Accordingly, the correction current IDtmax will be maximized at Vtmax and the correction current IDtmin will be minimized (zero) at Vtmin in the sensor output values of step S2506.

Similarly, the correction profile data of the Vomax scanning position will be FFh, and the correction profile data of the Vomin scanning position will be 00h. Consequently, the correction current IDomax will be maximized at Vomax and the correction current IDomin will be zero at Vomin in the sensor output values of S2508.

Here, the correction currents ID obtained by multiplying the correction profile data (FFh etc.) by a voltage equivalent to the $V_{ref}$ value output by the reference voltage generating unit 1400 are thus proportionate to the $V_{ref}$ value. That is, since the correction profile data of the Vtmax and Vomax scanning positions is FFh, the correction currents ID of the Vtmax and Vomax scanning positions are proportionate to the respective $V_{ref}$ values. Accordingly, $V_{ref}$ in the present embodiment will be given by $$V_{oref} \times (IDtmax/IDomax)$$

and can be calculated by $$V_{oref} \times (Vtd/Vod)$$

where $V_{oref}$ is the DAC reference voltage with amount of light correction in a non-operational state. This calculation is executed by the CPU 1312.

(Step S2509)

At step S2509, the CPU 1312 reads out the DAC reference voltage $V_{oref}$ obtained with the amount of light correction in a non-operational state and stored in the NVRAM 1314 of the amount of light correction circuit 1302, and uses an Equation (4) to calculate a $V_{ref}$ value from Vtd and Vod calculated at steps S2507 and S2508.

$$V_{oref} \times (Vtd/Vod) \quad (4)$$

(Step S2510)

At step S2510, the control unit 1313 stores the $V_{ref}$ value calculated at step S2509 in the NVRAM 1314.

Environmental change and aging of negatively charged electric charge in the longitudinal direction of the developing roller such as illustrated in FIG. 4 can thus be flexibly addressed. The present embodiment contributes to cost reduction since sensors on the photosensitive drum surface do not need to be provided in the image-forming apparatus.

Note that while the present flowchart was, similarly to Embodiment 4, described using the yellow station as an example, processing is similarly executed for the other stations.

As described above, the present embodiment can contribute to cost reduction since the sensors 1701 to 1705 do not need to be provided in each image-forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2007-256012, filed Sep. 28, 2007, and 2008-195316 filed Jul. 29, 2008, which are hereby incorporated by reference herein in their entirety.

What is claimed is:

1. An image-forming apparatus that includes an image carrier, a laser emitting unit which emits a light beam that is wider than a single deflection surface of a rotating polygonal mirror to form a latent image on the carrier, and a developing unit which forms a toner image by developing a latent image formed by using toner, comprising:

a supply unit which supplies toner to the developing unit while carrying the toner in a longitudinal direction of the developing unit; and a correction unit which corrects nonuniformity in image density in a main scanning direction that occurs when exposure by the laser emitting unit is performed, by altering amount of emitted light of the laser emitting unit from one end to the other end of the image carrier, wherein the correction unit, in emitting light with a downwardly convex alternation of amount of emitted light in which amount of emitted light decreases and then increases from one end to the other end of the image carrier, differentiates a width by which amount of emitted light decreases from a width by which amount of emitted light increases, in order to correct fluctuation in image density caused by nonuniformity, due to an angle between the deflection surface and the emitted light beam, of an upwardly convex light amount distribution in which amount of light increases in a portion between two edge portions in the main scanning direction, and by continuous alteration in charging characteristics of the toner used, from an end of the image carrier corresponding to an upstream side in a carrying direction of the toner to the other end of the image carrier corresponding to a downstream side in the carrying direction of the toner.

2. The image-forming apparatus according to claim 1, wherein the width by which amount of emitted light decreases is greater than the width by which amount of emitted light increases.

3. The image-forming apparatus according to claim 1, comprising:

a storage unit which stores a plurality of correction profiles for altering the amount of the emitted light of the laser emitting unit from one end to the other end of the image carrier;

a density detecting unit which detects a gradient of density alteration from one end to the other end of the image carrier; and a setting unit which reads a corresponding correction profile from the storage unit based on a detection result of the density detecting unit, and sets the read correction profile in the correction unit.

4. The image-forming apparatus according to claim 1, comprising:

a storage unit which stores a plurality of correction profiles for altering the amount of the emitted light of the laser emitting unit from one end to the other end of the image carrier; and a setting unit which reads a corresponding correction profile from the storage unit according to an operating state of the image-forming apparatus, and sets the read correction profile in the correction unit.

5. The image-forming apparatus according to claim 1, comprising:

a density detecting unit which detects fluctuation in image density from one end to the other end of the image carrier; and a determining unit which determines a correction profile for correcting nonuniformity in a light amount distribution in which amount of light corresponding to a detection result of the density detecting unit is reflected.

6. The image-forming apparatus according to claim 5, wherein the determining unit which determines the correction profile includes a calculating unit which calculates a correction profile for causing the laser emitting unit to emit a downwardly convex alternation of amount of emitted light that corrects a post-reflection upwardly convex light amount distribution obtained by reflecting the detection result of the density detecting unit in the nonuniformity of the upwardly convex light amount distribution.

7. The image-forming apparatus according to claim 1, wherein the toner is a one-component developing-material.

8. A control method in an image-forming apparatus that includes an image carrier, a laser emitting unit which emits a light beam that is wider than a single deflection surface of a rotating polygonal mirror to form a latent image on the carrier, and a developing unit which forms a toner image by using toner, comprising the steps of:

supplying toner to the developing unit while carrying the toner in a longitudinal direction of the developing unit; and correcting nonuniformity in image density in a main scanning direction that occurs when exposure by the laser emitting unit is performed, by altering amount of emitted light of the laser emitting unit from one end to the other end of the image carrier, wherein in the correction step, in emitting light with a downwardly convex alternation of amount of emitted light in which emitted light decreases and then increases from one end to the other end of the image carrier, a width by which amount of emitted light decreases is differentiated from a width by which amount of emitted light increases, in order to correct fluctuation in image density caused by nonuniformity, due to an angle between the deflection surface and the emitted light beam, of an upwardly convex light amount distribution in which amount of light increases in a portion between two edge portions in the main scanning direction, and by continuous alteration in charging characteristics of the toner used, from an end of the image carrier corresponding to an upstream side in a carrying direction of the toner to the other end of the image carrier corresponding to a downstream side in the carrying direction of the toner.

* * * * *